US007597313B2

(12) United States Patent
Dan

(10) Patent No.: US 7,597,313 B2
(45) Date of Patent: Oct. 6, 2009

(54) SHEET TRANSPORTING DEVICE AND IMAGE FORMING APPARATUS USING THE SAME

(75) Inventor: Kenichi Dan, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 429 days.

(21) Appl. No.: 11/483,651

(22) Filed: Jul. 11, 2006

(65) Prior Publication Data

US 2007/0020015 A1 Jan. 25, 2007

(30) Foreign Application Priority Data

Jul. 11, 2005 (JP) ..... 2005-201928

(51) Int. Cl.
*B65H 5/00* (2006.01)

(52) U.S. Cl. ..... 271/10.03; 271/110

(58) Field of Classification Search ..... 271/110, 271/111, 10.03
See application file for complete search history.

(56) References Cited

U.S. PATENT DOCUMENTS 4,449,705 A * 5/1984 Shibuya et al. ..... 271/9.09
5,016,864 A * 5/1991 Nonami ..... 271/38
5,230,573 A * 7/1993 Yasuoka et al. ..... 400/54
5,441,246 A * 8/1995 Miyata et al. ..... 271/9.11
5,451,039 A * 9/1995 Adachi ..... 271/9.06
5,678,814 A * 10/1997 Yokoyama et al. ..... 271/9.05
5,897,112 A * 4/1999 Kwag ..... 271/38
5,915,690 A * 6/1999 Surya ..... 271/265.01
6,152,631 A * 11/2000 Park ..... 400/708
6,292,636 B1 * 9/2001 Kwon ..... 399/16
6,422,773 B1 * 7/2002 Lim ..... 400/710
6,986,509 B2 * 1/2006 Koh et al. ..... 271/110
7,185,885 B2 * 3/2007 Chelvayohan ..... 271/110
7,374,163 B2 * 5/2008 Cook et al. ..... 271/145
7,515,867 B2 * 4/2009 Yano ..... 399/393
2004/0041329 A1 * 3/2004 Hiraoka ..... 271/110
2004/0061283 A1 * 4/2004 Hyun ..... 271/265.01
2004/0195757 A1 * 10/2004 Lyu et al. ..... 271/110
2006/0180986 A1 * 8/2006 Hattori ..... 271/110
2006/0188305 A1 * 8/2006 Murrell et al. ..... 399/388

FOREIGN PATENT DOCUMENTS

JP 09-249315 A 9/1997
JP 2001-206566 A 7/2001
JP 2002154695 A * 5/2002
JP 2004-269167 A 9/2004

* cited by examiner

*Primary Examiner*—Patrick H Mackey
*Assistant Examiner*—Howard Sanders
(74) *Attorney, Agent, or Firm*—Baker Botts, LLP

(57) ABSTRACT

A sheet transporting device includes: a sheet feeding cassette; a transporting unit that transports the sheet from the sheet feeding cassette; a swing member including a swing position, which changes among a first state in which the sheet feeding cassette is separated, a second state in which the sheet feeding cassette is mounted and the sheet is not transported, and a third state in which the sheet is transported; a detecting unit that detects whether the swing position of the swing member is in the second state; and a control unit, wherein when the detecting unit detects that the swing position of the swing member is in a state other than the second state within a predetermined time interval from the time that the transporting unit extracts the sheet from the sheet feeding cassette, the control unit determines that the swing position is in the third state.

17 Claims, 20 Drawing Sheets

WAVEFORMS OF SENSORS AT NORMAL PRINTING

WAVEFORMS OF SENSORS IN CASE OF SEPARATING OF CASSETTE DURING TRANSPORTING

OTHER SENSORS IS USED FOR CHANGING

WAVEFORMS IN CASE OF OCCURRENCE OF OVERLAP TRANSPORTING

OVERLAP TRANSPORTING IS DETERMINED BY USING SHEET EMPTY SENSOR

SHEET TRANSPORTING DEVICE AND IMAGE FORMING APPARATUS USING THE SAME

CROSS-REFERENCE TO THE RELATED APPLICATION(S)

This application is based upon and claims a priority from prior Japanese Patent Application No. 2005-201928 filed on Jul. 11, 2005, the entire contents of which are incorporated herein by reference.

TECHNICAL FIELD

Aspects of the present invention relate to a sheet transporting device and an image forming apparatus using the same.

BACKGROUND

A conventional sheet feeding apparatus is disclosed in JP-A-2001-206566. The conventional sheet feeding apparatus includes a sheet feeding cassette where sheets are stacked, rollers for transporting the sheet sheet-by-sheet, a sheet edge detecting sensor that includes a photo sensor and an actuator for determining a sheet transporting timing (transporting interval) and a detecting switch for detecting presence and absence of the sheet feeding cassette.

SUMMARY

In JP-A-2001-206566, the transporting of the sheet and the presence and absence of the sheet feeding cartridge are detected by using a plurality of dedicated detecting units. In such a configuration, the number of parts increases, and so the number of assembling processes increases, and the assembling processes are complicated. Further, this hinders the ability to reduce the size of the apparatus and the ability to reduce the cost.

Aspects of the present invention provide a sheet transporting device capable of detecting presence and absence of a sheet feeding cassette, the sheet transporting device having a small number of parts and an image forming apparatus using the sheet transporting device.

According to an aspect of the invention, there is provided a sheet transporting device including: a main body; a sheet feeding cassette detachable from the main body; a transporting unit that extracts sheets sheet-by-sheet and transports the sheet from the sheet feeding cassette; a swing member swingablly supported by a shaft to the main body, the swing member including a swing position, which changes among a first state in witch the sheet feeding cassette is separated, a second state in witch the sheet feeding cassette is mounted and the sheet is not transported, and a third state in witch the sheet feeding cassette is mounted and the sheet is transported; a detecting unit that detects whether the swing position of the swing member is in the second state or other states; and a control unit that receives signal from the detecting unit, wherein when the detecting unit detects that the swing position of the swing member is in a state other than the second state within a predetermined time interval from the time that the transporting unit extracts the sheet from the sheet feeding cassette, the control unit determines that the swing position is in the third state.

According to the aspect, within a predetermined time interval from the time that the transporting unit extracts the sheet from the sheet feeding cassette, when the detecting unit detects that the swing position of the swing member is in a state other than the second state, it is determined that the swing position is in the third state. Therefore, the transporting of the sheet and the presence and absence of the sheet feeding cassette can be detected by a single detecting unit. As a result, the number of parts for the detecting can be reduced. Further, the number of assembling processes can be reduced and simplified. Further, it is possible to reduce the size of the apparatus.

According to another aspect of the invention, there is provided a sheet transporting device including: a main body; a sheet feeding cassette detachable from the main body; a transporting unit that extracts sheets sheet-by-sheet and transports the sheet from the sheet feeding cassette; a swing member swingablly supported by a shaft to the main body, the swing member including a swing position, which changes among a first state in witch the sheet feeding cassette is separated, a second state in witch the sheet feeding cassette is mounted and the sheet is not transported, and a third state in witch the sheet feeding cassette is mounted and the sheet is transported; a first detecting unit for detecting whether the swing position of the swing member is in the second state or other states; a second detecting unit disposed at a downstream of the first detecting unit in a sheet transporting path to detect a sheet transporting state; a control unit to which signals from the first and second detecting unit are input, wherein when the second detecting unit does not detect the sheet and when the first detecting unit detects that the swing position of the swing member is in a state other than the second state after a predetermined time interval from the time that the transporting unit extracts the sheet from the sheet feeding cassette, the control unit determines that the sheet feeding cassette is in a separated state.

According to the aspect, after a predetermined time interval from the time that the transporting unit extracts the sheet from the sheet feeding cassette, when the second detecting unit does not detect the sheet and when the first detecting unit detects that the swing position of the swing member is in a state other than the second state, it is determined that that the sheet feeding cassette is in a separated state. Therefore, the state, which the sheet feeding cassette is separated during the transporting of the sheet, can be accurately detected.

According to another aspect of the invention, there is provided a sheet transporting device including: a main body; a sheet feeding cassette detachable to the main body; a transporting unit that extracts sheets sheet-by-sheet and transports the sheet from the sheet feeding cassette; a swing member swingablly supported by a shaft to the main body, the swing member including a swing position, which changes among a first state in witch the sheet feeding cassette is separated, a second state in witch the sheet feeding cassette is mounted and the sheet is not transported, and a third state in witch the sheet feeding cassette is mounted and the sheet is transported; a first detecting unit for detecting whether the swing position of the swing member is in the second state or other states; a second detecting unit disposed at a downstream of the first detecting unit in a sheet transporting path; a third detecting unit for detecting a presence or absence of the sheet in the sheet feeding cassette; and a control unit to which signals from the first to third detecting unit are input, wherein when the second detecting unit detect a rear portion of the sheet, when the first detecting unit detects that the swing position of the swing member is in a state other than the second state, and when the third detecting unit detects the presence of the sheet, the control unit determines that the sheet is in an overlap transporting state.

According to the aspect, when the second detecting unit detect a rear portion of the sheet, when the first detecting unit detects that the swing position of the swing member is in a state other than the second state, and when the third detecting unit detects the presence of the sheet, it is determined that the sheet is in an overlap transporting state. Therefore, the overlap transporting can be accurately detected.

According to another aspect of the invention, there is provided a sheet transporting device including: a main body; a sheet feeding cassette detachable to the main body; a transporting unit that extracts sheets sheet-by-sheet and transports the sheet from the sheet feeding cassette; a swing member swingablly supported by a shaft to the main body, the swing member including a swing position, which changes among a first state in witch the sheet feeding cassette is separated, a second state in witch the sheet feeding cassette is mounted and the sheet is not transported, and a third state in witch the sheet feeding cassette is mounted and the sheet is transported; a detecting unit for detecting whether the swing position of the swing member is in the second state or other states; and a control unit to which signals from the detecting unit are input, wherein when the detecting unit detects that the swing position of the swing member is in a state other than the second state for a predetermined time or more, the control unit determines that the sheet feeding cassette is in a separated state.

According to the aspect, when the detecting unit detects that the swing position of the swing member is in a state other than the second state for a predetermined time or more, it is determined that the sheet feeding cassette is in a separated state. Therefore, the separated state of the sheet feeding cassette can be accurately detected.

According to another aspect of the invention, there is provided an image forming apparatus including the sheet transporting device according to the above aspects.

According to the aspect, a sheet transporting device includes the sheet transporting device according to the above aspects. Therefore, the number of parts for the detecting can be reduced. Further, the number of assembling processes can be reduced and simplified. Further, it is possible to reduce the size of the apparatus.

BRIEF DESCRIPTION OF THE DRAWINGS

These and other objects and advantages of the present invention will be more fully apparent from the following detailed description taken in conjunction with the accompanying drawings, in which.

DETAILED DESCRIPTION OF THE ILLUSTRATIVE ASPECTS

Now, aspects of the present invention will be described with reference to the accompanying drawings.

First Aspect

Figure 1:
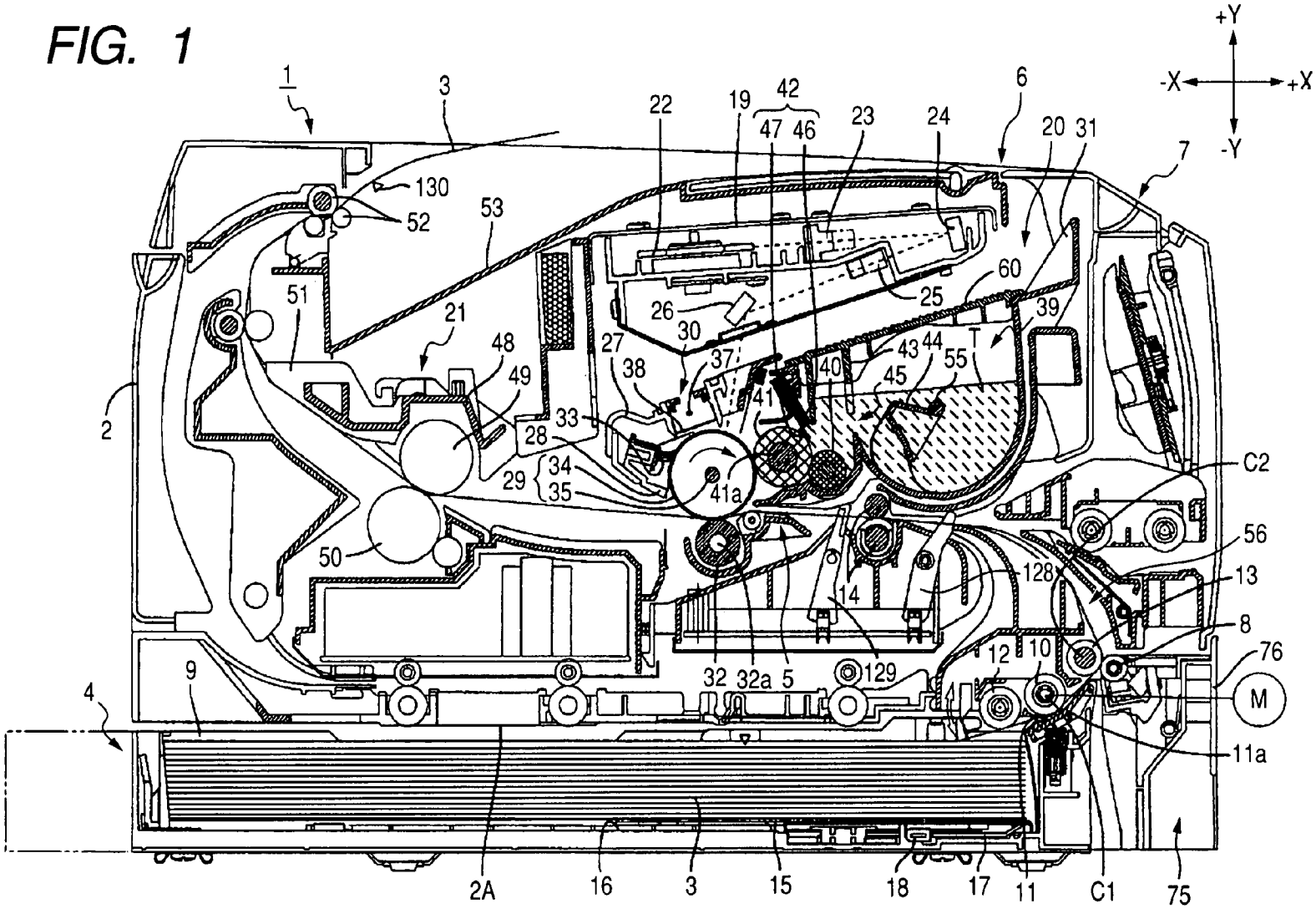
FIG. 1 is a side cross sectional view showing a laser printer as an image forming apparatus according to an aspect of the present invention.
Figure 2:
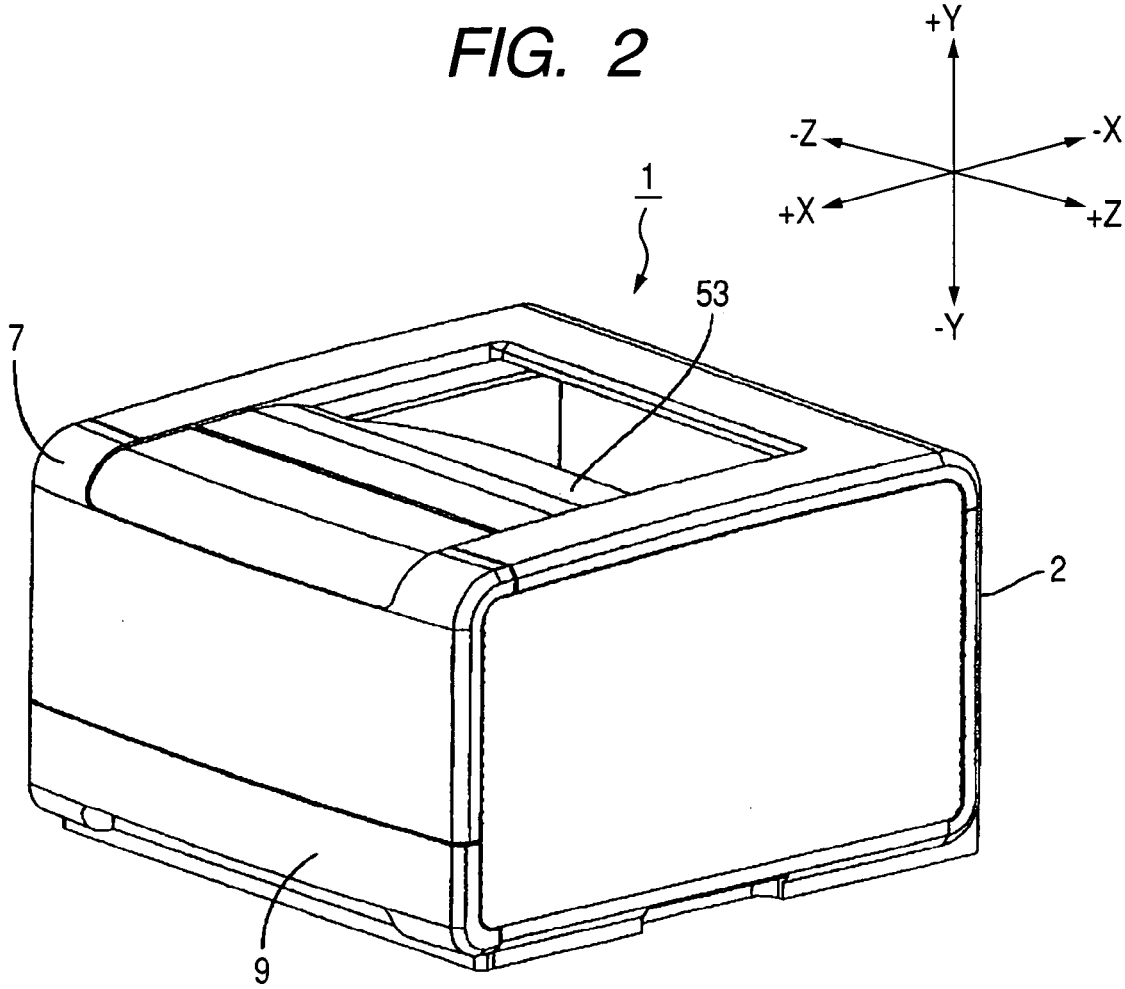
FIG. 2 is a perspective view showing the laser printer of FIG. 1.
Figure 3:
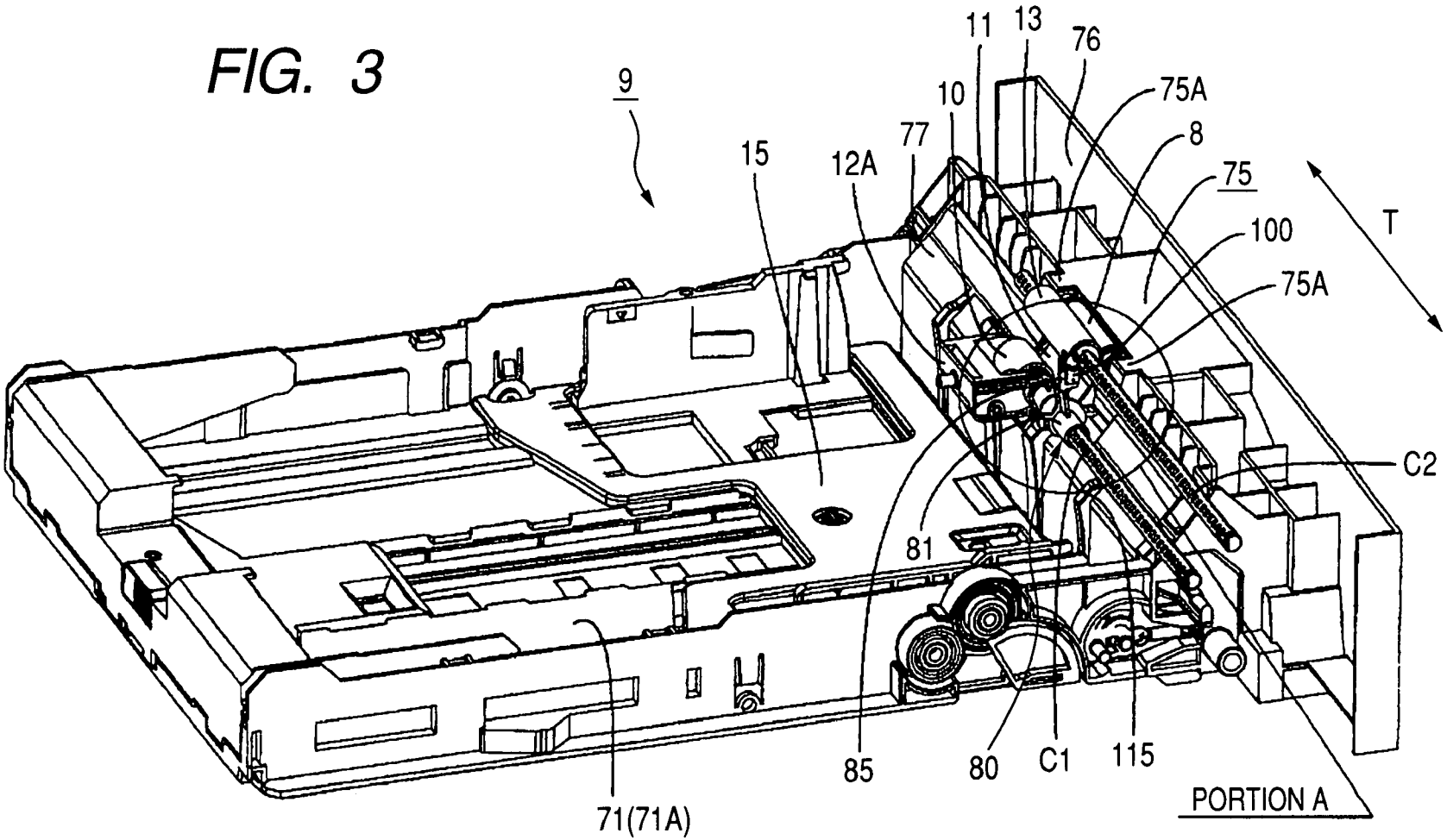
FIG. 3 is a perspective view showing a sheet feeding cassette of FIG. 1.
Figure 4:
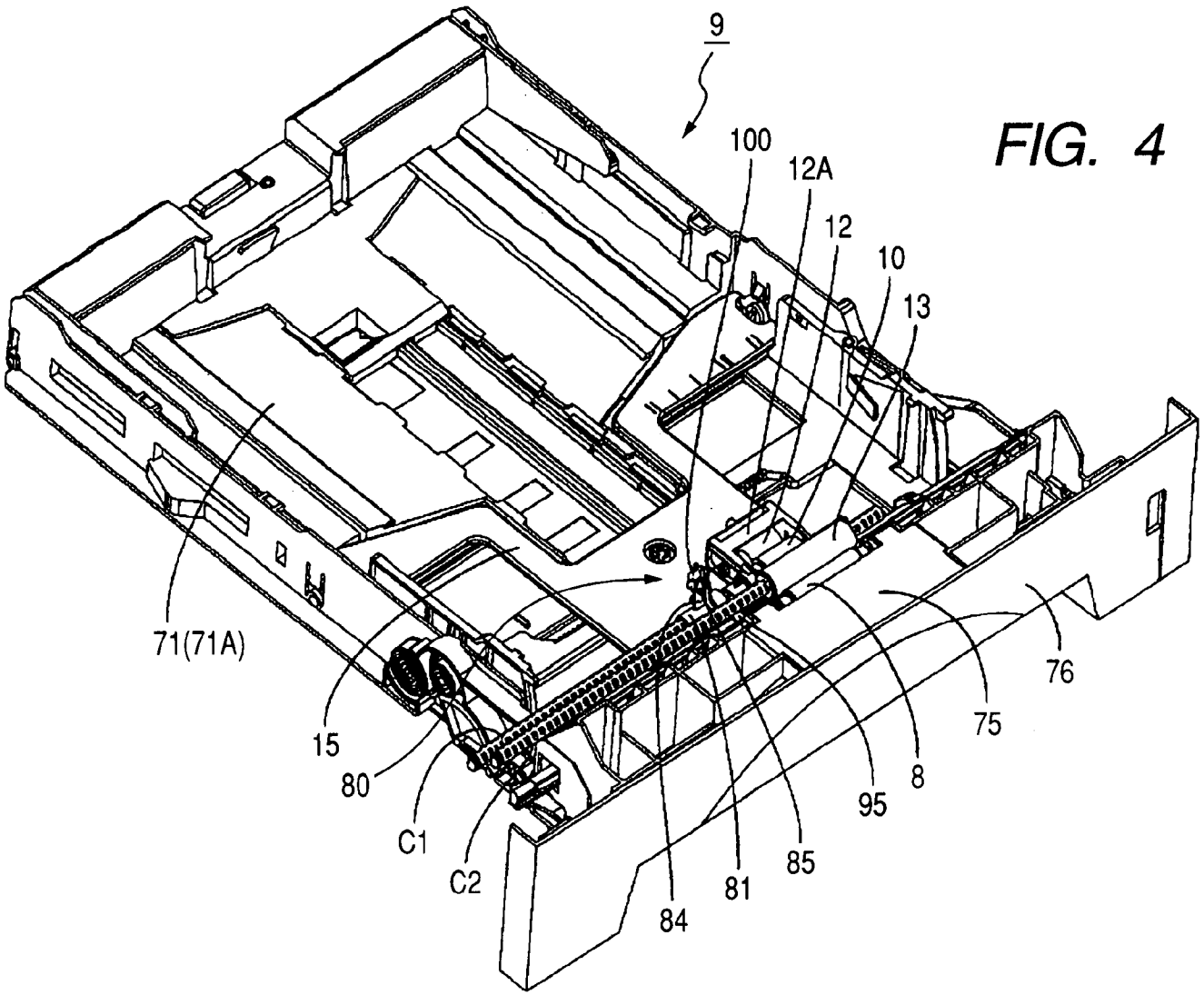
FIG. 4 is a perspective view showing a sheet feeding cassette of FIG. 1.

FIG. 1 is a side cross sectional view showing a laser printer as an image forming apparatus according to a first aspect of the invention. FIG. 2 is a perspective view showing the laser printer of FIG. 1. FIGS. 3 and 4 are perspective views showing a sheet feeding cassette of FIG. 1. In the following description, an inner depth direction of the laser printer is defined as an X direction (front side is defined as +X), a width direction thereof is defined as a Z direction (right front side of FIG. 2 is defined as +Z), and a height direction thereof is defined as a Y direction (upper side of FIG. 2 is defined as +Y).

The laser printer 1 includes a casing 2, a feeder unit 4 for feeing a sheet 3 as a recording medium, an image forming unit 5 for forming an image on the fed sheet 3, and the like.

As shown in FIGS. 1 and 2, a mounting/separating opening 6, which mounts and separates a later-described process cartridge 20, and a front cover 7, which opens and closes the mounting/separating opening 6, are formed on one side wall of a casing 2 (a main body). The front cover 7 is rotatably supported by a cover shaft (not shown), which is inserted into a lower portion thereof.

As shown in FIG. 1, when the front cover 7 is folded around the cover shaft as a center thereof, the mounting/separating openings 6 is closed by the front cover; and when the front cover 7 is unfolded (slanted down) around the cover shaft, the mounting/separating opening 6 is opened. Therefore, the process cartridge 20 can be attached to and detached from the casing 2 through the mounting/separating opening 6.

A cassette receiving portion 2A, which is opened toward a front side thereof, is formed on a bottom surface of the casing 2. A sheet feeding cassette 9 is received or separated by manipulation at the front side (right side of FIG. 2).

The feeder unit 4 includes the sheet feeding cassette 9 and rollers for transporting the sheet 3 sheet-by-sheet in the sheet transporting path 56. As shown in FIG. 3, the sheet feeding cassette 9 includes: a cassette body 71 having a shape of a tray with a shallow bottom in which the sheets 3 are stacked and a wall portion 75 disposed in front thereof. A sheet pressing plate 15 is attached to a front portion of a bottom wall 71A of the cassette body 71. In FIG. 3, a left side edge of the sheet pressing plate 15 is fixed to the bottom wall 71A, and an opposite side end thereof is not fixed but bent in up and down directions.

A lever 17 is disposed between a distal end portion of the sheet pressing plate 15 and the bottom wall 71A of the sheet feeding cassette 9 (see FIG. 1). The lever 17 is allowed to rotate around a lever shaft 18. When a rotation driving force is input to the lever shaft 18 in a counterclockwise direction in the figure, the lever 17 rotates around the lever shaft 18. Therefore, a front end portion of the lever 17 lifts up the sheets stacked on a front end of sheet pressing plate 15 or on the sheet feeding cassette 9. Therefore, the sheet 3 can contact a feed roller 12.

The wall portion 75 includes a front plate 76 having a shape of a plate and a slanted plate 77 opposite to the front plate 76 and slanted in a down direction toward the cassette body 71. In a width-directional central portion of the slanted plate 7, a paper dust removal roller 8 and a separation pad 11 are disposed at the upper and lower portions thereof. In the slanted plate 7, guide pieces 115 are formed to protrude toward an inner portion of the cassette (left side of FIG. 3). Five guide pieces 115 are formed along the width direction of the sheet feeding cassette 9 (T direction of FIG. 3 and Z direction of the main body).

Figure 6:
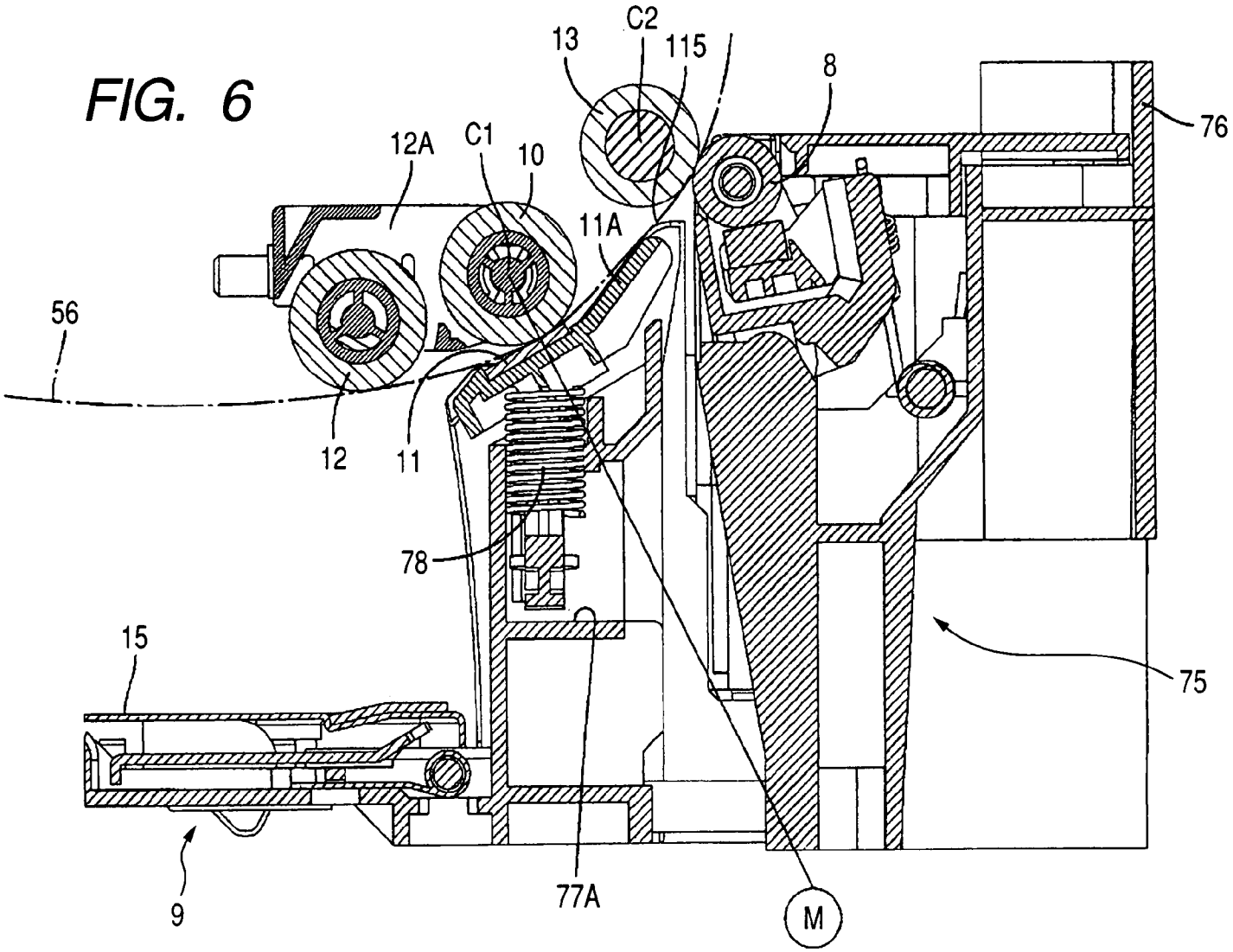
FIG. 6 is a cross sectional view taken along line B-B of FIG. 5.

With respect to the paper dust removal roller 8, a shaft line thereof is directed in the width direction of the sheet feeding cassette 9, and both end portions of the rotation shaft thereof are held by a pair of holding walls 75A, which are formed on the wall portion 75. As shown in FIG. 6, a concave portion 77A is formed on the slanted plate 7 of the wall portion 75, which is located under the paper dust removal roller 8. A coil spring 78, of which an upper end is fixed to a pad pressing plate 11A, is received in the concave portion in the vertical direction. A separation pad 11 is attached on an upper surface of the pad pressing plate 11A.

As shown in FIG. 1, a feed roller 12, a separation roller 10, an opposite roller 13 are disposed in this order at a front side of a top wall of the cassette receiving portion 2A, that is, at a position corresponding to the wall portion 75 of the sheet feeding cassette 9. As shown in FIG. 3, a central shaft C1 (a shaft) of the separation roller 10 and a central shaft C2 of the opposite roller 13 are disposed so that they extend in the width direction of the sheet feeding cassette 9. In addition, in a state that shaft lines thereof are directed in a direction perpendicular to the sheet transporting direction, both end portions of the central shafts C1 and C2 are supported by the casing 2. On the other hand, unlike the separation roller 10 or the opposite roller 13, the feed roller 12 does not have a central shaft connected to the casing 2. Instead, the feed roller 12 is held by a substantially ⊏-shaped holder 12A so that the feed roller 12 is rotatable with the central shaft C1.

FIGS. 3 and 4 are perspective views of the sheet feeding cassette. The separation roller 10, the opposite roller 13, and the feed roller 12 are parts that are attached to the casing 2. Therefore, the separation roller 10 and the opposite roller 13 are parts that would not be seen in a natural view in the figures. However, the separation roller 10 and the opposite roller 13 are shown in the figures in order to explain a relation between them and the sheet feeding cassette 9 or the roller 8 disposed in the cassette.

A swing link (a swing member) is externally inserted to the central shaft C1 to be parallel to the separation roller 10. The swing link 80 is provided in order to detect separation of the sheet feeding cassette 9 from the cassette receiving portion and sheet transporting.

As shown in FIG. 1, when the sheet feeding cassette 9 is received in the cassette receiving portion 2A, the front plate 76 of the sheet feeding cassette 9 is aligned with the front wall of the casing 2 to close the inlet of the cassette receiving portion 2A. At this time, the separation roller 10 and the separation pad 11 face each other, and the paper dust removal roller 8 and the opposite roller 13 faces each other.

A sheet transporting path 56 is formed by the rollers 8, 10, 12 and 13 and the guide pieces of the wall portion 75. At this time, by an elastic force of the coil spring 78, the separation pad 11 is pressed toward the separation roller 10. Accordingly, a suitable frictional force is exerted between the transported sheets. Further, it is possible to prevent a plurality of the sheets 3*e* from being fed in an overlap stat to the sheet transporting path 56.

In FIG. 1, reference numeral M denotes a driving motor. When the motor is driven, a driving torque is transmitted through power transmission gears (not shown) so that the shaft C and the rollers 10, 12, and 13 can rotate. As shown in FIG. 1, the sheet transporting path 56 is designed to be curved in a shape of U in the vicinity of the paper dust removal roller 8 in a backward direction (left direction in the figure). In addition, a register roller constructed with a pair of rollers is disposed under the process cartridge 20. Therefore, by driving the motor M, the sheet 3 can be transported along the sheet transporting path 56 to a later-described image forming unit 5.

Driving of the motor M is controlled by a control unit (a unit which electrically controls the whole apparatus). In the aspect, the casing 2 is provided with a mechanism for disconnecting a power supply for the motor driving circuit by the separating of the sheet feeding cassette 9. In a case where the sheet feeding cassette 9 is separated from the cassette receiving portion 2A, the motor M is designed to be stopped.

The image forming unit 5 includes a scanner unit 19, a process cartridge 20, a fixing unit 21, and the like.

The scanner unit 19 is disposed at an upper portion in the casing 2, and the scanner unit 19 includes a laser source (not shown), a rotation-driven polygon mirror 22, an fθ lens 23, a reflecting mirror 24, a lens 25, and a reflecting mirror. As shown by a dashed line of FIG. 1, a laser beam which is emitted from the laser source based on image data is deflected toward the polygon mirror 22. After the laser beam passes through the fθ lens 23, the light path thereof is curved by the reflecting mirror 24. After the laser beam passes the lens 25, the light path thereof is curved downward, so that the laser beam can be irradiated on a surface of a later-described photosensitive drum 20 of the process cartridge 20.

The process cartridge 20 is mounted under the scanner unit 19 and is detachable from the casing 2. The process cartridge 20 includes an upper frame 27, which is a case member, and a lower frame 28, which is formed as a separate member of the upper frame 27 to be assembled with the upper frame 27. In addition, a case body of the process cartridge 20 includes: photosensitive drum 29, as an image containing structure; a Scorotron type electric charger 30, as an electric charging unit; a develop cartridge 31; a transfer roller 32, as a transporting unit; and a cleaning brush 33.

The photosensitive drum 29 has a cylindrical shape. The photosensitive drum includes a drum body 34, which has a photosensitive layer made of polycarbonate, and a metal drum shaft 35, which is a shaft aligned with a central axis of the drum body 34 and extending in a longitudinal direction of the drum body 34. The drum shaft 35 is supported by the upper frame 27, and the drum body 34 is rotatably supported by the drum shaft 35. Therefore, the photosensitive drum 29 is disposed to freely rotate around the drum shaft 35 in the upper frame 27.

The Scorotron type electric charger 30 is supported by the upper frame 27 and disposed at the upper slanted portion of the rear side of the photosensitive drum 29 to face the photosensitive drum 29 by a predetermined interval so as not to contact the photosensitive drum 29. The Scorotron type electric charger 30 includes a discharge wire 37, which is disposed to face the photosensitive drum 29 by a predetermined interval, and a grid 38, which is interposed between the discharge wire 37 and the photosensitive drum 29 to control discharging amount from the discharge wire 37 to the photosensitive drum 29. In the Scorotron type electric charger 30, corona discharge is generated by applying a bias voltage to the grid 39 and a high voltage to the discharge wire 37. Therefore, the surface of the photosensitive drum 29 can be uniformly charged with a positive polarity.

The develop cartridge 31 includes a box type receiving case 60 having an open rear side. The develop cartridge 31 is detachably mounted on the lower frame 28. A toner containing chamber 39, a toner supply roller 40, a develop roller 41, and a layer thickness regulating blade 42 are disposed in the developing cartridge 31.

The toner container 39 is partitioned by a partition plate 60 to be formed as a front side inner space of the receiving case 60. The toner container 39 is filled with a toner T, as a developing material. The toner T includes positively charged nonmagnetic components. An example of the toner T is a polymer toner formed by copolymerizing polymeric monomers in a suspension polymerization process or the like. Here, as an example of the polymeric monomer, there are styrene based monomers such as styrene and acryl based monomers such as acryl acid, alkyl (C1-C4) acrylate and alkyl (C1-C4) methacrylate. The polymer toner has a substantially spherical shape and a good flowing property, so that a high quality image can be formed.

A colorant such as carbon black or wax is mixed in the toner T, and an external additive such as silica is added to the toner T in order to improve the flowing property. An average particle size of the toner is in a range of from about 6 μm to about 10 μm.

In addition, an agitator 44 is disposed in the toner containing chamber 39. The agitator 44 is supported by a rotation shaft 55 formed at the center thereof. Rotation of the agitator 44 is driven by a motor (not shown). When the agitator 44 is rotated, the toner T in the toner containing chamber 39 is stirred and discharged from an opening portion 45 toward the toner supply roller 40. The opening portion 45 is disposed at the lower portion of the partitioning plate 43 to extend in the forward and backward directions. In the left and right side walls of the receiving case 60, window members (not shown) are formed at regions corresponding to the toner containing chamber 39. The window members are cleaned by wipers which are supported and cooperated by the agitator 44. In the casing 2, a light emitting device (not shown) is disposed at an outer side of the one window member, and a light receiving member (not shown) is disposed at an outer side of the other window member. Detection light emitted from the light emitting device and passing through the receiving case 60 is detected by the light receiving device, and the presence and absence of the toner T are determined according to an output value thereof.

The toner supply roller 40 is disposed at the rear side of the opening portion 45 and rotatably supported by the develop cartridge 31. The toner supply roller 40 is constructed by coating a roller shaft having a shape of a metal pipe with a conductive foaming material.

The develop roller 41 is disposed at the rear side of the toner supply roller 40 and rotatably supported by the develop cartridge 31 in a state that the develop roller and the toner supply roller 40 press and contact each other. The develop roller 40 faces and contacts the photosensitive drum 29 in a state that the develop cartridge 31 is mounted on the lower frame 28.

The both end portions of the roller shaft 41*a* are formed to extend at the front end portion of the develop cartridge 31 from the side surface of the develop cartridge 31 in a width direction (Z axis direction) of the main body. In the roller of the develop roller 41, a surface of the roller body made of a conductive urethane rubber or silicon rubber containing carbon particles or the like is coated with a coating layer made of an urethane rubber or silicon rubber containing fluorine. During the developing process, the develop roller 41 is applied with a develop bias. The rotation of the develop roller 41 is driven in a rotational direction that is the same as that of the toner supply roller 40 by an input of a power from a motor (not shown).

In the layer thickness regulating blade 42, a pressing member 47, which has a shape of a semicircle and is made of an insulating silicon rubber, is disposed at the front end portion of the blade body 46 constructed with a metal plate spring member. The layer thickness regulating blade 42 is disposed at the upper portion of the develop roller 41 to be supported by to the develop cartridge 31. The layer thickness regulating blade is pressed by the pressing member 47 by means of the elastic force of the blade body 46 so as to contact the develop roller 41.

The toner T discharged from the opening portion 45 is supplied to the develop roller 41 by the rotation of the toner supply roller 40. At this time, the toner is charged with a positive polarity by friction between the toner supply roller 40 and the develop roller 41. The toner T supplied to the develop roller 41 is inserted between the pressing member 47 of the layer thickness regulating blade 42 and the develop roller 41 by the rotation of the develop roller 41. Thus, the toner T is contained on the develop roller 41 as a thin film having a predetermined thickness.

The transfer roller 32 is rotatably supported by the lower frame 28. In a state when the upper frame 27 and the lower frame 28 are assembled. The transfer roller is disposed to face and contact the photosensitive drum 29 in the up down direction, and a nip is formed between the transfer roller and the photosensitive drum 29. The transfer roller 32 is constructed by coating a metal roller shaft 32 with a roller made conductive rubber material. During the transfer, the transfer roller 32 is applied with a transfer bias.

The cleaning brush 33 is attached to the lower frame 28, and in a state that the upper frame 27 and the lower frame 28 are assembled. The cleaning brush 33 is disposed at the rear side of the photosensitive drum 29 to face and contact the photosensitive drum 29.

The surface of the photosensitive drum 29 is uniformly charged with a positive polarity by the Scorotron type electric charger 30 by the rotation of the photosensitive drum 29. After that, the surface thereof is exposed by high speed scanning of the laser beam from the scanner unit 19. An electrostatic latent image corresponding to an image, which is to be formed on the sheet 3, is formed.

Subsequently, when the toner which is contained on the develop roller 41 and has a positive electric charge, faces and contacts the photosensitive drum 29 by the rotation of the develop roller 41, the toner is supplied to the electro-static latent image which is formed on the surface of the photosensitive drum 29, that is, the exposed portion in which electric potential is lowered by the photo sensing of the laser beams on the uniformly charged surface of the photosensitive drum 29. As a result, the electro-static latent image of the photosensitive drum 29 is changed into a visual image, and a toner image is contained on the surface of the photosensitive drum 29 due to an inversion phenomenon.

After that, as shown in FIG. 1, when the sheet 3 transported by the register roller 14 passes through a transfer position between the photosensitive drum 29 and the transfer roller 32, the toner image contained on the surface of the photosensitive drum 29 is transferred on the sheet 3 by a transfer bias applied to the transfer roller 32. The sheet 3, on which the toner image is transferred, is transported to the fixing unit 21.

In addition, after the transfer, the transfer remaining toner which remains on the photosensitive drum 29 is recycled by the develop roller 41. In addition, after the transfer, the paper dust from the sheet 3 attached on the photosensitive drum 29 is recycled by the cleaning brush 33.

The fixing unit 21 is disposed at a rear side of the process cartridge 20 and includes a fixing frame 48, a heat roller 49 and press roller 50. The heat roller 49 and press roller 50 are disposed in the fixing frame 48.

The heat roller 49 includes a metal pipe with a surface coated with a fluorine resin and a halogen lamp disposed within the metal pipe to be used for heating. Rotation of the heat roller is driven by an input of power from a motor (not shown). On the other hand, the press roller 50 is disposed to face the heat roller 49 so as to press the heat roller 49 under thereof. The press roller 50 is constructed by coating a metal roller shaft with a roller made of a rubber material, and the press roller is driven according to the rotation driving of the heat roller 49.

In the fixing unit 21, while the sheet 3 passes between the heat roller 49 and the press roller 50, the toner, which is transferred on the sheet at the transfer position thereof, is thermally-fixed. The sheet 3 on which the toner is fixed is transported to a sheet discharging path 51 which extends in the up/down direction toward the top surface of the casing 2. The sheet 3, which is transported to the sheet discharging path 51, is discharged on a sheet discharging tray 53, which is formed on the top surface of the casing 2, by a sheet discharging roller 52, which is disposed at an upper side of the sheet discharging path.

Figure 5:
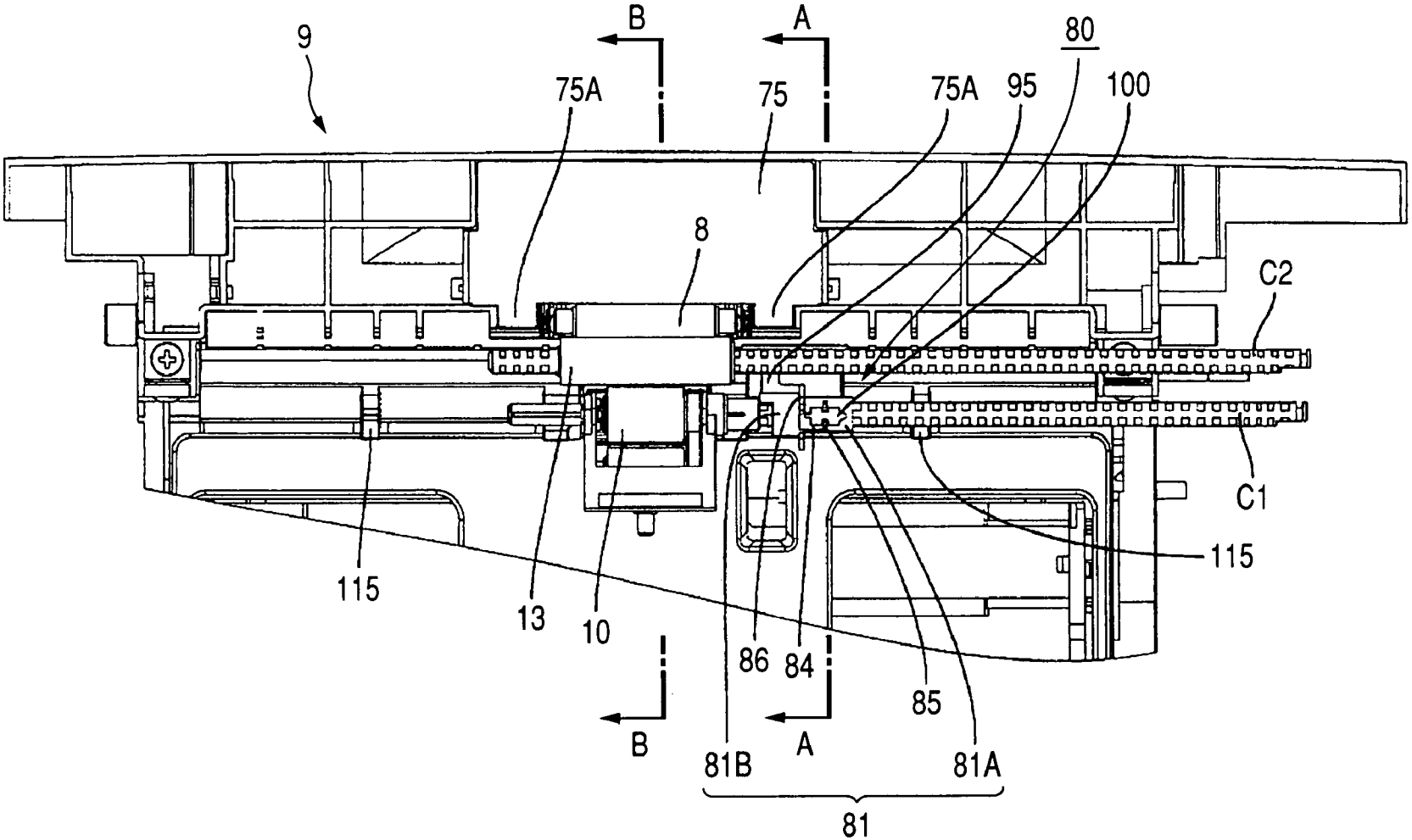
FIG. 5 is a plan view showing a sheet feeding cassette.
Figure 7:
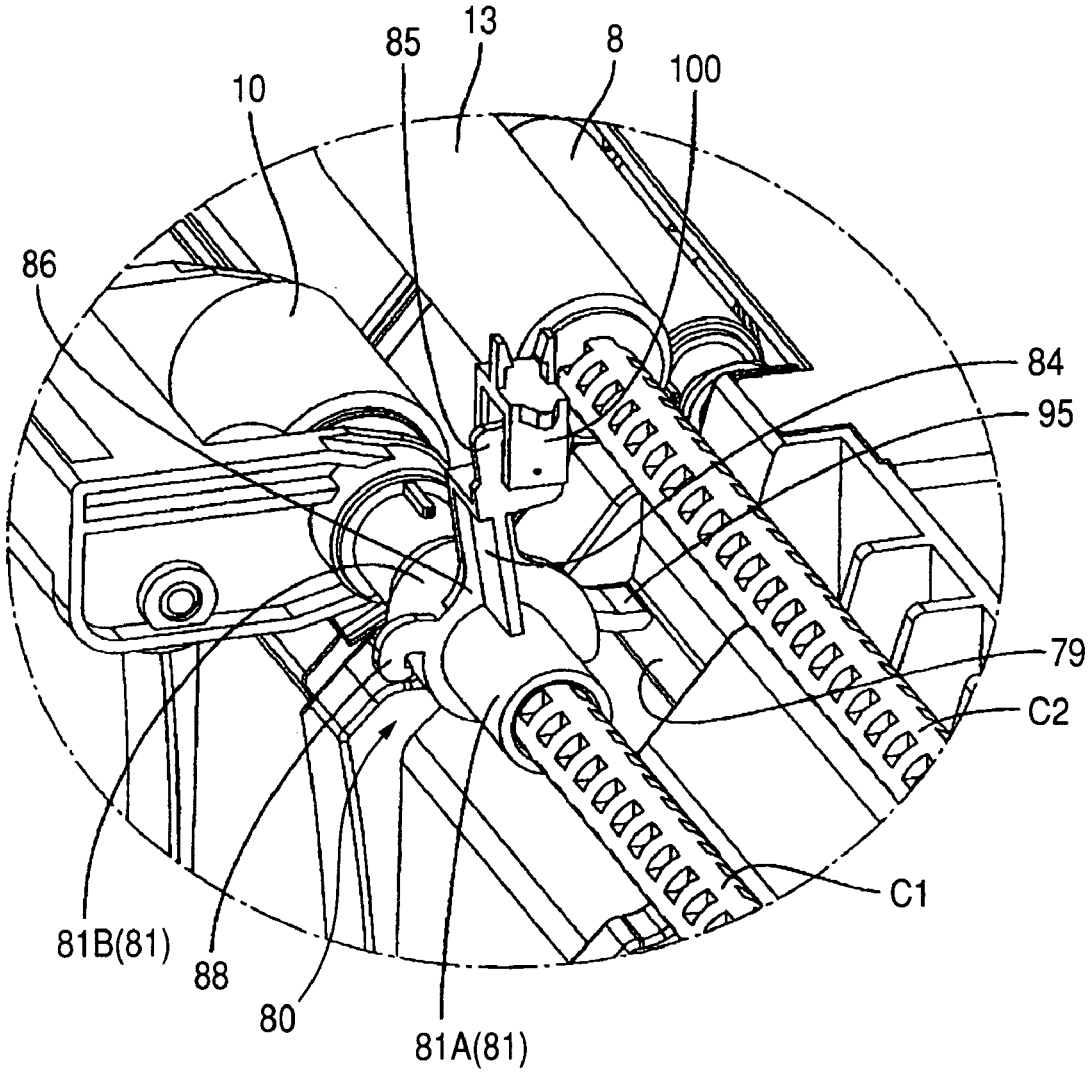
FIG. 7 is an enlarged view of a portion A of FIG. 3.
Figure 8:
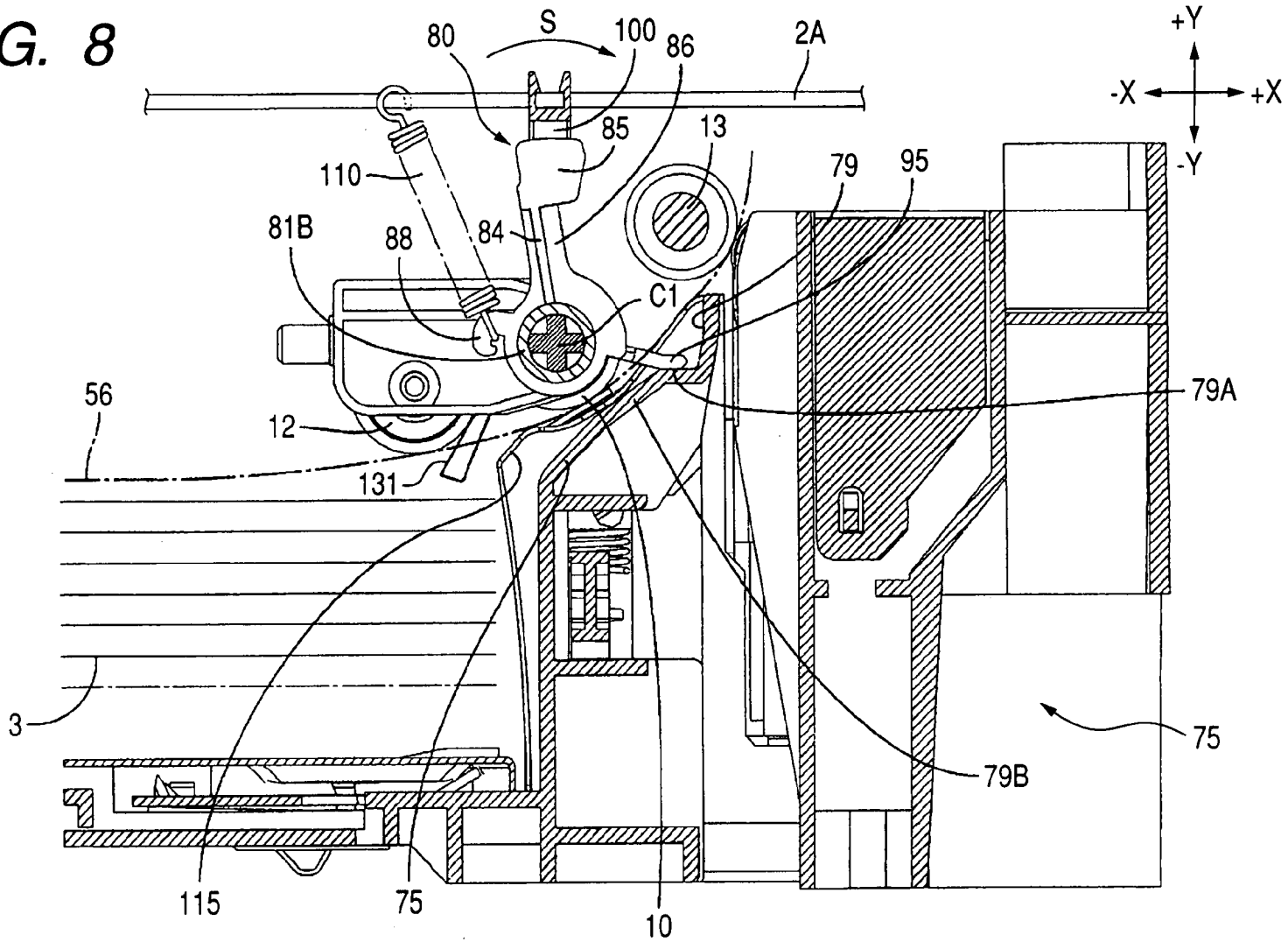
FIG. 8 is a cross sectional view showing a second state of a swing link.
Figure 9:
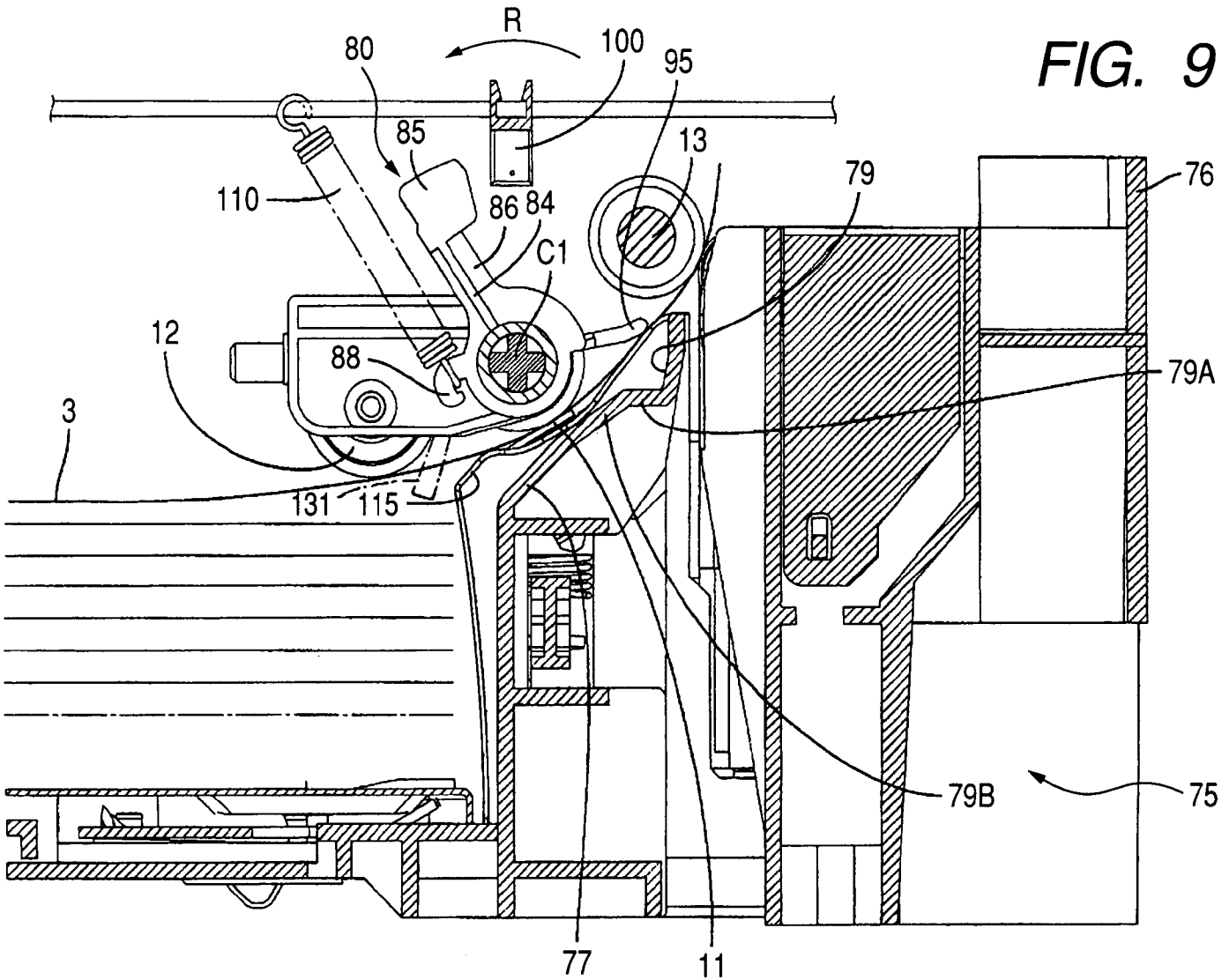
FIG. 9 is a cross sectional view showing a third state of the swing link.
Figure 10:
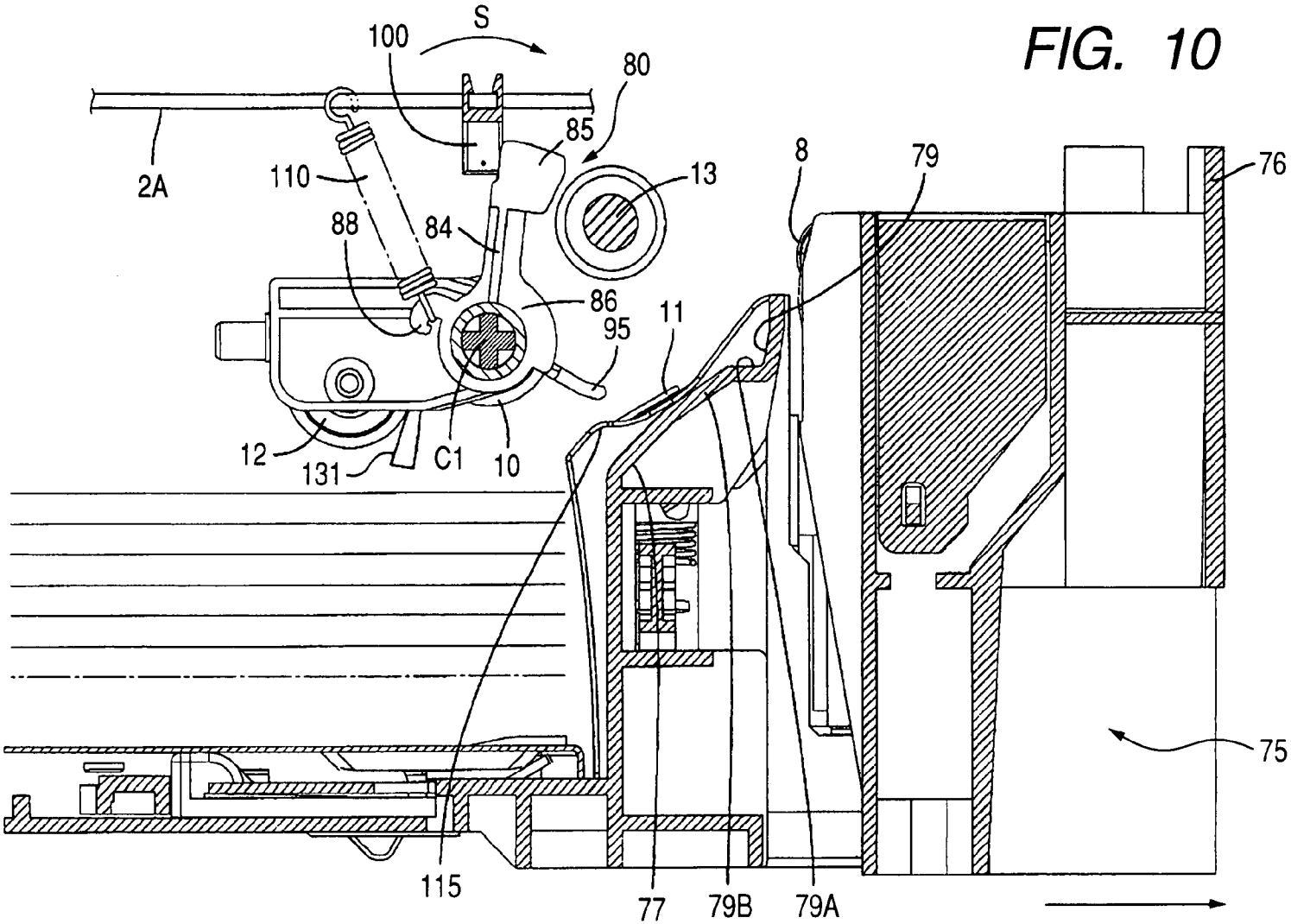
FIG. 10 is a cross sectional view showing a first state of the swing link.
Figure 11:
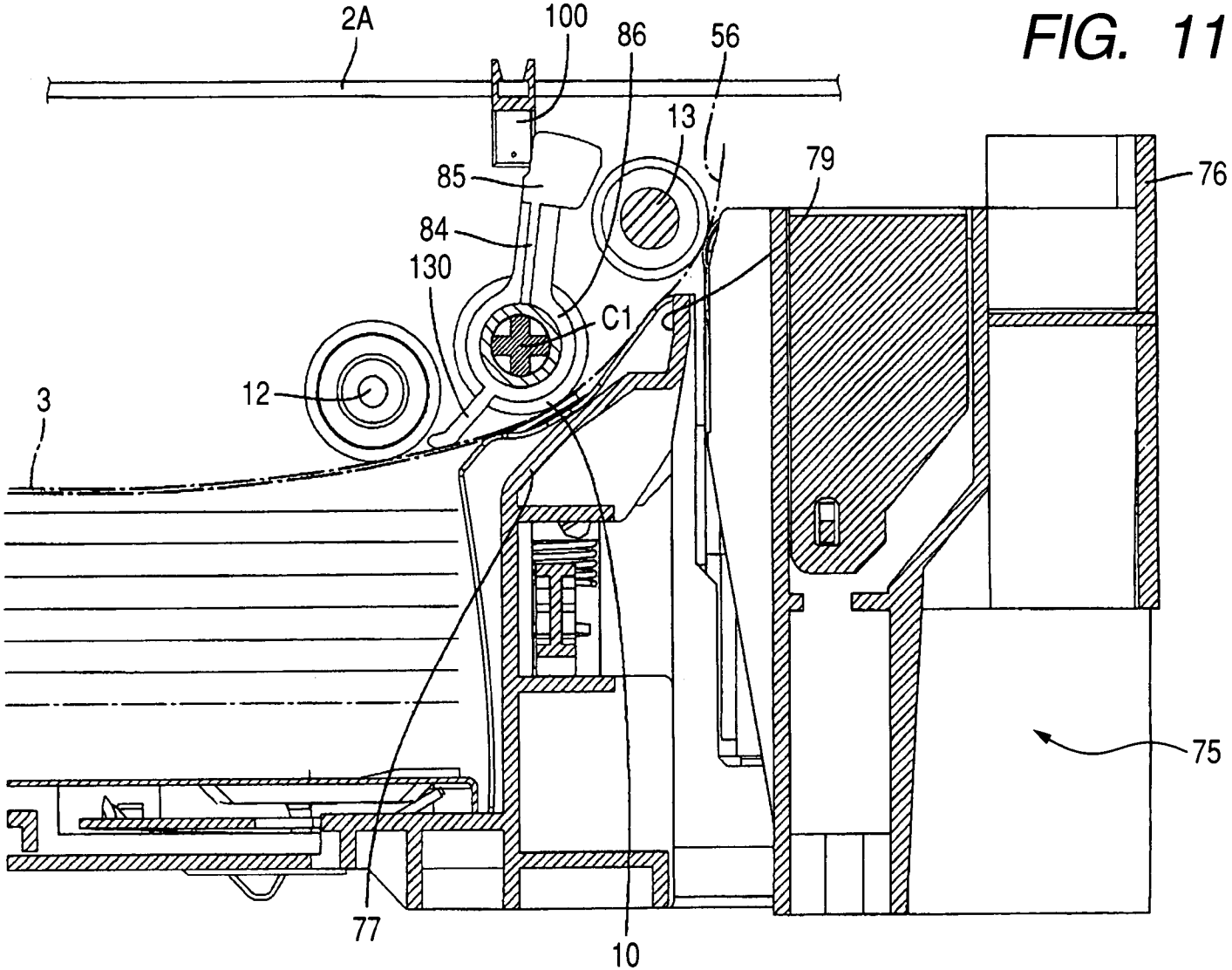
FIG. 11 is a cross sectional view showing a case where a protruding plate portion is disposed at an upstream of a separation roller.

FIG. 5 is a plan view showing a sheet feeding cassette (only the front side thereof is shown). FIG. 6 is a cross sectional view taken along line B-B of FIG. 5. FIG. 7 is an enlarged view of a portion A of FIG. 3. FIG. 8 is a cross sectional view showing a second state of a swing link (a cross sectional view taken along line A-A of FIG. 5). FIG. 9 is a cross sectional view showing a third state of the swing link. FIG. 10 is a cross sectional view showing a first state of the swing link. FIG. 11 is a cross sectional view showing a case where a protruding plate portion is disposed at an upstream of a separation roller.

First, a construction of the swing link 80 will be described, and after that, a change in states (positions) of the swing link 80 involved with transporting of the sheet 3 and mounting and separating of the sheet feeding cassette 9 will be described.

As shown in FIGS. 5 and 7, the swing link 80 includes cylindrical body portion 81. The body portion 81 is constructed by connecting a thin small diameter portion 81A and a thick large diameter portion 81B. The body portion is inserted into central shaft C1 to be rotatable around the central shaft (rotating not integrally with the central shaft C1 but freely from the central shaft). An arm 84 is formed on the small diameter portion 81A, and a protruding plate portion 95 is formed on the large diameter portion 81B for the sheet feeding cassette 9.

The arm 84 extends from an outer periphery of the small diameter portion 81A upward. A light blocking plate 85 is formed on one end surface (front end surface in FIG. 7) of the arm, and a reinforcement wall 86 is formed on an opposite end surface (rear end surface of FIG. 7) thereof.

The light blocking plate 85 has substantially a shape of a rectangle that extends from an upper portion of the arm 84 in a longitudinal direction of the sheet feeding cassette 9 (X axis direction of the main body). The reinforcement wall 86 is formed along substantially an entire height of the arm 84. A distal end side of the reinforcement wall 86 is formed to have a constant width, and a base end side of the reinforcement wall 86 is formed to have a width larger than that of the distal end side. A hook-shaped spring fixing portion 88 is formed at the base end side of the reinforcement wall 86, which is a front left side of FIG. 7.

Now, a photo-electric sensor 100 for detecting a blocking object will be described. The photo-electric sensor is a counter part of the light blocking plate 85. The photo-electric sensor 100 is constructed with a pair of light-emitting and light-receiving devices facing each other (in the aspect, a transparent type photo-interrupter including a package of the photo-electric devices is used). The photo-electric sensor 100 includes a detecting unit and a first detecting unit according to the present invention.

With respect to the photo-electric sensor 100, an optical axis thereof is set to be aligned with the central shaft C1 of the separation roller 10 at the upper position of the swing link 80 on the top wall of the cassette receiving portion 2A, and in the mounting state (a state that the photo-electric sensor 100, the swing link 80, and the sheet feeding cassette 9 are mounted and the sheet 3 is not transported), the light blocking plate 85 of the swing link 80 is set to be located between the light emitting device and the light receiving device.

As shown in FIG. 5, the protruding plate portion 95 extends from an outer peripheral surface of the large diameter portion 81B toward the wall portion 75 of the sheet feeding cassette 9. With respect to a width of the protruding plate portion 95, a distal end side thereof is formed to be narrower, and a base end side thereof is formed to have a width equal to the entire width of the large diameter portion 81B. In FIG. 5 a left cross section thereof is formed to be continuous with the reinforcement wall 86.

As shown in FIGS. 7 and 8, a receiving portion 79, which has a concave shape in a down direction toward the wall surface, is formed at an opposite position of the protruding plate portion 95 on the wall portion 75. A bottom wall of the receiving portion 79 includes a flat base surface 79A for supporting the protruding plate portion 95 at a lower portion thereof and a slanted guide surface 79B for guiding the protruding plate portion 95 to the base surface 79A according to the operation of mounting the sheet feeding cassette 9. As shown in the figure, a distal end of the protruding plate portion 95 has a slightly curved shape.

Now, change in the state of the swing link 80 will be described.

As shown in FIG. 8, when the sheet feeding cassette 9 is mounted in the cassette receiving portion 2A, the protruding plate portion 95 crosses the sheet transporting path 56 to allow the curved distal end thereof to override the base surface 79*a* of the receiving portion 79. At this time, the arm 84 is in an erected state in a substantially vertical direction, and the light blocking plate 85 is in a state where a light path of detection light irradiated by the light emitting device is blocked (hereinafter, referred to as an OFF state of sensor output). The state in which the protruding plate portion 95 is supported by the base surface 79*a* of the receiving portion 79 at the lower portion thereof is defined as a second state of the swing link 80. Namely, the second state of the swing link 80 is a state in which the sheet feeding cassette 9 is mounted in the cassette receiving portion 2A and the sheet 3 is not transported.

In FIG. 8, reference numeral 110 denotes a coil spring. One end of the coil spring 110 is suspended on the top wall of the cassette receiving portion 2A, and the other end thereof is hooked at the spring fixing portion 88 of the swing link 80. In the second state, the coil spring elastically supports the swing link 80 in a direction S in the figure.

In a before-transporting state, since the protruding plate portion 95 crosses the sheet transporting path 56 when the transporting of the sheet 3 starts, the protruding plate portion 95 rides on the sheet 3. As a result, the swing link 80 rotates in an arrow direction (direction R) shown in FIG. 9. By the rotation, the light blocking plate 85 is retracted from the light path of the detection light. As a result, the photo-electric sensor 100 is in a light receiving state (hereinafter, referred to as an ON state of the sensor output). The state the protruding plate portion rides on the sheet shown in FIG. 9 is defined as a third state of the swing link 80. Namely, the third state of the swing link 80 is a state that the sheet feeding cassette 9 is mounted in the cassette receiving portion 2A and the sheet 3 is transported.

During a time period that the sheet 3 is transported, since the lower surface of the protruding plate portion 95 is supported by the sheet 3, the swing link is maintained in the third state. When the rear edge of the sheet 3 pass through the protruding plate portion 95, since the supporting of the sheet 3 is removed (since the swing link is in a free state), the swing link 80 returns to the initial second state by the operation of the elastic supporting force of the aforementioned coil spring 110.

Next, when the sheet feeding cassette 9 is separated in the state of FIG. 8 (when the cassette is moved in the right direction of the figure), as shown in FIG. 10, the state in which the lower portion of the protruding plate portion 95 supported by the receiving portion 79 is released. Just after the releasing, since the swing link 80 is in a state that the elastic supporting force of the coil spring 110 is exerted thereon, the swing link rotates in the direction S shown in FIG. 10. In addition, a stopper (not shown) is provided to the swing link 80, so that the rotation can be stopped by the stopper contacting the end portion of the separation roller 20. At this time, the light blocking plate 85 is retracted from the light path of the detection light. As a result, the photo-electric sensor 100 is in the light receiving state (ON state). The state is defined as a first state of the swing link 80. Namely, the first state of the swing link 80 is a state in which the sheet feeding cassette 9 is separated from the cassette receiving portion 2A.

On the other hand, when the sheet feeding cassette 9 is inserted into the cassette receiving portion 2A in the state, the curved distal end portion of the protruding plate portion 95 contacts the slanted guide surface 79B of the wall portion 75 during the insertion of the cassette 9. Next, the swing link 80 rotates by the guiding operation of the slanted guide surface 79B against the elastic supporting force of the coil spring 110. When the sheet feeding cassette 9 is received in the cassette receiving portion 2A, the protruding plate portion 95 rides on the slanted guide surface 79B to be in the state that the protruding plate portion is supported by the base surface 79*a* of the receiving portion 79 at the lower portion thereof, that is, the second state shown in FIG. 7.

The distal end of the protruding plate portion 95 is curved, and the slanted guide surface 78B is formed on the wall portion 75 as a counter part thereof. Therefore, when the sheet feeding cassette 9 is mounted in the cassette receiving portion 2A, leading of the protruding plate portion 95 on the base surface 79A can be smoothly performed. As a result, after the protruding plate portion 95 contacts the wall portion 75, the protruding plate portion 95 can not be broken due to the protruding tension state thereof.

Determination of light blocking and light receiving states of the photo-electric sensor 100 is performed by a later-described control unit based on signals received from the light receiving device. Determination of driving of the motor M is performed by the control unit based on pulse signals from a speed control rotary encoder attached to the motor.

When the sheet transporting is determined, a sheet transporting timing for the next transported sheet is determined based on ON/Off of the photo-electric sensor 100 as follows.

Firstly, the photo-electric sensor 100 can detect the timing that the OFF state (light blocking state) is changed into the ON state (light receiving state of the third state) to detect the passing of the front edge of the sheet 3. On the contrary, the photo-electric sensor 100 can detect the timing that the ON state (light receiving state of the third state) is changed into the OFF state (light blocking state) to detect the passing of the rear edge of the sheet 3. Therefore, in a case where the second state is changed into the third state, the sheet is extracted from the sheet feeding cassette 9, and after that, the sheet 3 is transported, so that the front and rear ends of the sheet can be detected. In addition, in a case where the third state is changed into the second state, the rear end of the transported sheet 3 can be detected.

As methods of determining the transporting timing, there are a method based on the passing of the front edge of the sheet 3 and a method based on the passing of the rear edge of the sheet 3. The aspect employs the latter method, that is, the method of detecting the passing the rear end of one sheet of the sheet 3 and, after that, transporting the next sheet 3. Under the control, mis-operation in which the next sheet is transported before the transporting of the one sheet of the sheet 3 is completed can be prevented in advance.

When the transporting timing of the sheet 3 is determined, it is preferable that the transporting interval is set to a period of time that is as short as possible in terms of high speed printing. For this reason, in the aspect, the coil spring 110 is provided to elastically support the swing link 80 in the returning direction (direction that the swing link returns from the third state to the second state). Therefore, in comparison with a case where biasing units are not provided, the returning time (time for returning from third state to the second state) tcan be shorted so that a delay of ON/OFF timing of the photo-electric sensor 100 for transporting of the sheet 3 can be shortened. Therefore, an error corresponding to the detection delay can be eliminated by determining the transporting timing of the sheet 3 based thereon so that the transporting time can be set to the shortest time.

In addition, in order to detect the rear edge of the sheet 3, a setting for returning the swing link 80 from the third state to the second state every time when the one sheet of the sheet 3 passes must be made. Therefore, in the aspect, the protruding plate portion 95 is disposed at the lower stream of the sheet transporting path 56 with respect to the separation roller 10 (at the right side FIG. 8). When the protruding plate portion 130 is located at the upstream of the separation roller 10 as shown in FIG. 11, the location is a position before the sheet 3 is separated. Therefore, the sheets 3 may be in an overlapped state. As described later, a state in which the sheets 3 are transported in the overlapped state is referred as overlapped transporting.

In this state, although the one sheet of the overlapped sheets 3 passes, the swing link 80 does not return to the second state, and the rear portion of the sheet 3 cannot be detected. However, according to the aforementioned construction (construction in which the protruding plate portion 95 is disposed at the downstream of the separation roller 10) when the sheet 3 passes, the swing link 80 can always return to the second state.

When the coil spring 110 is provided, the change from the second state to the first state as well as the aforementioned change from the third state to the second state can be performed in a short time. As a result, the detection of the separating of the sheet feeding cassette 9 can be performed in a short time.

Figure 12:
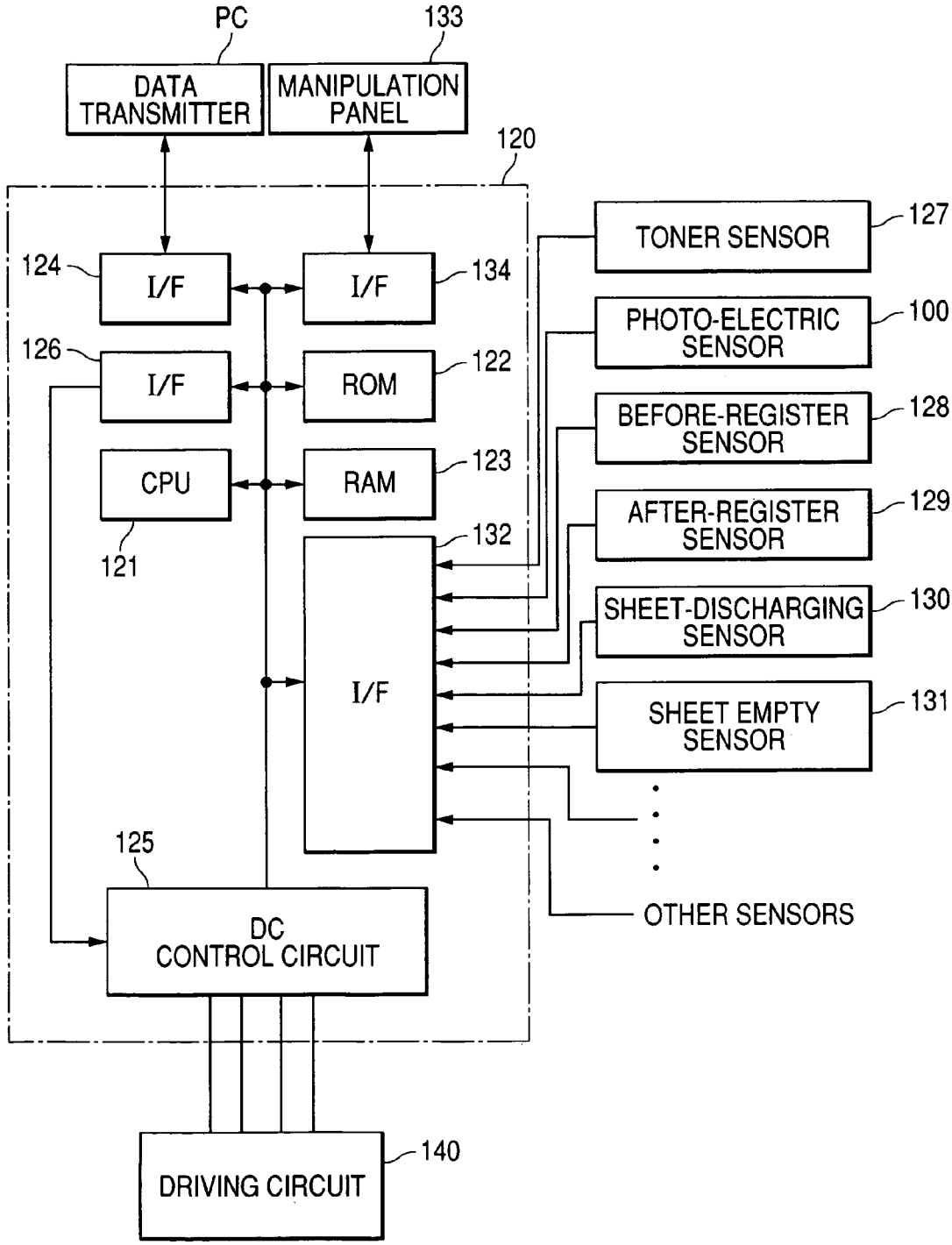
FIG. 12 is a block diagram showing a control unit.

Now, the control unit 120 will be described. FIG. 12 is a block diagram showing a construction of the control unit 120.

The control unit 120 as a control unit includes a CPU 121, a ROM 122 in which various control programs are stored, a RAM 123 including various memories such as a receiving buffer for receiving transmitting data transmitted from external data transmitter PC such as a personal computer and a host computer and storing the data, an interface (I/F) 124 for receiving transmitted printing data, an interface (I/F) 126 having a scan buffer to sequentially output printing-character information which is converted to bit image data to a DC controller circuit 125, an interface (I/F) 132 for receiving detection signals from a toner sensor 127 for determining the presence or absence of the toner T as described above, the aforementioned photo-electric sensor 100, a before-register sensor 128, an after-register sensor 129, a sheet-discharging sensor 130, a sheet empty sensor 131, other sensors, and an interface (I/F) 134 for selecting various control modes from a manipulation panel 133 and receiving converted signals thereof. These components can be connected to a CPU 121 via a bus 135.

The after-register sensor 129 corresponds to the second detecting unit of the present invention. The sheet empty sensor 131 for detecting the presence and absence of the sheet 3 within the sheet feeding cassette 9 corresponds to the third detecting unit of the present invention.

In addition, as shown in FIG. 1, the before-register sensor 128 is disposed at an upstream of the register roller 14 in the sheet transporting path 56. The after-register sensor 129 is disposed at a downstream of the register roller 14 in the sheet transporting path 56. In addition, the sheet-discharging sensor 130 is also disposed at a downstream of the sheet-discharging roller 52 in the sheet transporting path 56. As shown in FIGS. 8 to 10, an actuator of the sheet empty sensor 131 is rotatably attached to the central shaft C1. At the feeding time, when the sheet 3 stacked on the sheet feeding cassette 9 is lifted up, the actuator contacts an upper surface of the sheet 3 to rotate in the clockwise direction. An empty sensor (not shown) constructed with a pair of light-emitting and light-receiving devices (in the aspect, a transparent type photo-interrupter including a package of the photo-electric devices) capable of detecting positions of the actuator can detect a state in which the sheet 3 is present in the sheet feeding cassette 9, a state in which the sheet feeding cassette 9 is separated, and a state in which the sheet feeding cassette 9 is mounted but the sheet 3 is absent therein.

The DC controller circuit 125 is connected to a driving circuit 140 for driving various roller, motors, or heaters not shown.

The ROM 72 stores various control programs for implementing the aforementioned functions and a memory managing program for managing memory capacities of memories, such as a font memory for storing printing-character dot pattern data corresponding to a plurality of characters such as letters or symbols, a printing-character memory, and a receiving data buffer formed in the RAM 73 and front addresses thereof. In addition to the aforementioned data, the ROM 72 stores time data including a sum of a time interval from the time that the feeding from the sheet feeding cassette starts to the time that the front edge of the sheet 3 reaches the photo-electric sensor 100 and a marginal time interval for the sliding of the sheet 3, which is taken into consideration as a timer value in advance.

When the timer value and the time of the presence of the sheet 3 are detected, or when the sheet 3 is actually detected by the photo-electric sensor 100, the RAM 123 stores sheet presence/absence flag data for maintaining (locking) the detection states.

Now, a combination of the states of the photo-electric sensor 100 and the sheet empty sensor 131 will be described.

FIGS. 13A to 13D are views for explaining combination states of a photo-electric sensor and a sheet empty sensor. The photo-electric sensor 100 according to the present invention detects the rear edge of the sheet 3 transported as described above and the presence or absence of the sheet feeding cassette 9 (opening or closing of the feeding tray). Namely, when the sheet 3 is present in the sheet feeding cassette 9, and when the sheet feeding cassette 9 is separated, the photo-electric sensor 100 is in the ON state. In addition, when the sheet feeding cassette 9 is in the separated state, or when the sheet 3 is absent, the sheet empty sensor 131 detects the absence of the sheet 3.

Figure 13A:
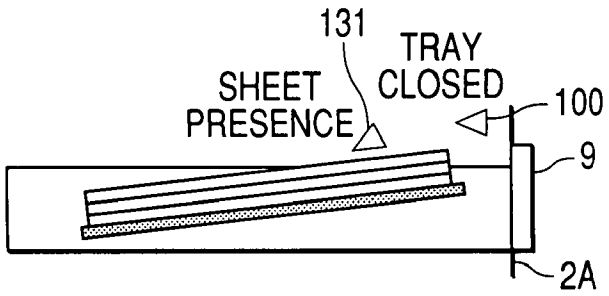
FIGS. 13A to 13D are views showing combination states of a photo-electric sensor and a sheet empty sensor.

In FIG. 13A, the mounting of the sheet feeding cassette 9 is detected by the photo-electric sensor 100, and the sheet 3 is detected by the sheet empty sensor 131. The figure shows a normal state, that is, the second state in which the sheet feeding cassette 9 receiving the sheets 3 is mounted in the casing 2 and the sheet 3 is not transported.

Figure 13B:
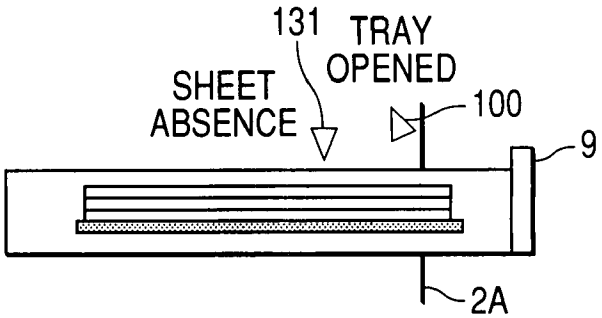

In FIG. 13B, the separating of the sheet feeding cassette 9 is detected by the photo-electric sensor 100, and in a case where the sheet feeding cassette 9 is separated, the absence of the sheet 3 is detected by the sheet empty sensor 131. The figure shows the first state in which the sheet feeding cassette 9 is separated from the casing 2.

Figure 13C:
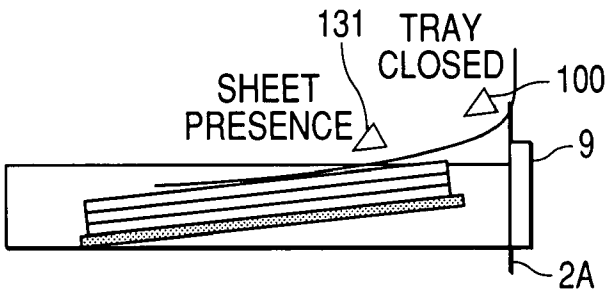

In FIG. 13C, the mounting of the sheet feeding cassette 9 is detected by the photo-electric sensor 100, and the sheet 3 is detected by the sheet empty sensor 131. However, since the sheet 3 is transported (overlap-transported) in a case where the sheet feeding cassette 9 is mounted, the figure shows the third state in which the sheet feeding cassette 9 receiving the sheet 3 is mounted in the casing 2 and the sheet is transported (or overlap-transported).

Figure 13D:
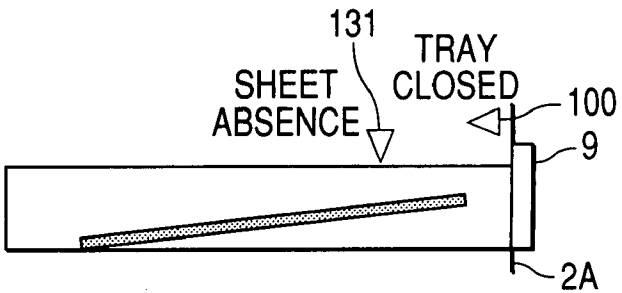

In FIG. 13D, the mounting of the sheet feeding cassette 9 is detected by the photo-electric sensor 100, the absence of the sheet 3 is detected by the sheet empty sensor 131. The figure shows a fourth state in which the sheet feeding cassette 9 is mounted in the casing 2 and the sheet 3 is absent in the sheet feeding cassette 9.

Now, the entire operation according to the aspect will be described in brief with reference to FIG. 1.

When the feeding operation involved with the image formation operation of the laser printer 1 starts, the driving motor M is driven. Accordingly, the front edge of the sheet pressing plate 15 of the sheet feeding cassette 9 and the sheet 3 stacked in the sheet feeding cassette 9 are lift up, so that the sheet 3 contacts the feed roller 12. At the time, the sheet empty sensor 131 contacts the upper surface of the sheet 3 to detect a state of sheet presence.

The sheet 3, which is located at the uppermost surface to contact the feed roller 12, is extracted from the sheet feeding cassette 9. The sheet 3 is transported along the sheet transporting path 56 by the separation roller 10, the opposite roller 13, and the roller 8 toward the register roller 14. At this time, the swing link 80 rotates in the arrow direction (direction R) shown in FIG. 9. By the rotation, the light blocking plate 85 is retracted from the light path of the detection light. As a result, the photo-electric sensor 100 is in the light receiving state so that the photo-electric sensor changes from the second state to the third state.

When the before-register sensor 128 detects the front edge of the sheet 3, the rotation of the register roller 14 is temporarily stopped, and the slanting of the sheet is corrected. When the register roller 14 rotates again, the after-register sensor 129 detects the front edge of the sheet, and an electro-static latent image is formed on the photosensitive drum 29 by the scanner unit 19 in synchronization with the timing. Next, the sheet 3 is transported toward the photosensitive drum 29.

When the sheet 3 reaches the photosensitive drum 29, the toner image formed on the photosensitive drum 29 is transferred on the sheet by the transfer roller 32.

After the toner image transferred on the sheet 3 is fixed by the fixing unit 21, the sheet is discharged through a sheet-discharging path to the sheet-discharging tray 53 disposed on the upper surface of the casing 2.

In addition, during the transporting of the sheet 3, when the rear edge of the sheet 3 passes through the swing link 80, the swing link rotates in the arrow direction(direction S) shown in FIG. 8. By the rotation, the light blocking plate 85 is located within the light path of the detection light, so that the light path of the detection light can be blocked. As a result, the photo-electric sensor changes from the third state to the second state.

Figure 14:
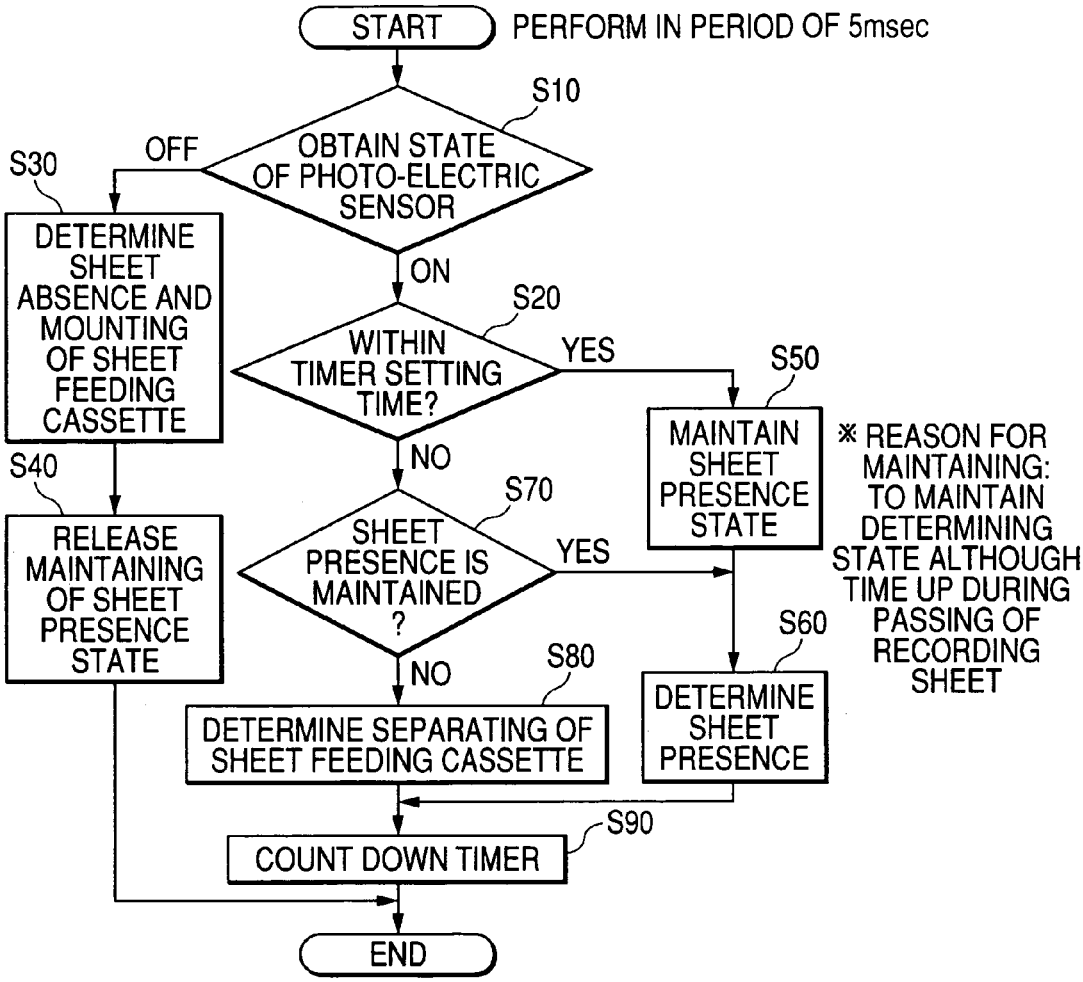
FIG. 14 is a flowchart showing operations of a control unit.

Now, operations of control unit will be described with reference to FIG. 14. FIG. 14 is a flowchart showing operations of the control unit according to the aspect.

Although the photo-electric sensor 100 according to the aspect is basically used to detect mounting and separating of the sheet feeding cassette 9, the photo-electric sensor may be used as a sheet rear end detection sensor for detecting the rear edge of the sheet 3 within a predetermined time interval after the rotation of the feed roller 12 or the like is driven and of the feeding operation of the sheet feeding cassette 9 starts, that is, during only the time interval that the timer is in a set state after the timer value is set to the RAM 123 by the CPU 121. The timer setting time is selected as a sum of a time interval from the time that the feeding starts to the time that the front edge of the sheet 3 reaches the photo-electric sensor 100 and a marginal time interval that a sliding of the sheet is taken into consideration, so that the timer setting time is typically set to 2 sec. In addition, the process shown in FIG. 14 is performed in a period of 5 msec.

In a setting state that the sheet feeding cassette 9 is mounted in the cassette receiving portion 2A and the sheet 3 is not transported, the swing link 80 is in the second state, and the photo-electric sensor 100 is in the light blocking state. On the other hand, in this state, when the sheet 3 is transported, or when the sheet feeding cassette 9 is separated, the swing link 80 is changed into the state that the light blocking plate 85 is retracted from the light path of the detection light. Accordingly, the photo-electric sensor 100 is in the light receiving state.

For the reason, as shown in FIG. 14, in Step S10 the CPU 121 determines whether or not the photo-electric sensor 100 is in the light blocking state in order to detect whether the swing link 80 is in the second state or changed from the second state, that is, a reference state to the other states (detection of change in state). Namely, the photo-electric sensor 100 can detect whether the swing link is in the second state or in the other state.

When the photo-electric sensor 100 is in the ON state (light receiving state) in Step S10, the process proceeds to Step S20. On the other hand, when the photo-electric sensor 100 is in the OFF state (light blocking), although the rotation of the feed roller 12 or the like is driven and the feeding operation of the sheet feeding cassette 9 starts, the photo-electric sensor 100 cannot detect the sheet 3. Therefore, the process proceeds to Step S30, and it is determined that the sheet 3 is absent and the sheet feeding cassette 9 is mounted. After that, the sheet presence/absence flag stored in the RAM 123 is set to "sheet absence" in Step S40 so that the maintaining of the sheet presence state is released, and the process ends. In the processes of Steps S30 and S40, the swing link 80 is in the second state.

In Step S10, in a case where the photo-electric sensor 100 is determined to be in the light receiving state, that is, in a case where the state of the swing link 89 is determined to be changed according to the transporting of the sheet 3, the process proceeds to Step S20. In Step S20, it is determined whether or not the timer is within a predetermined time as described above. When the timer is within the predetermined time (Step S20: Yes), the process proceeds to Step S50, and the sheet presence/absence flag stored in the RAM 123 is set to "sheet presence", so that the sheet presence state is maintained. Here, in a case where the sheet 3 is actually detected, when time-up is performed during the transporting of the sheet 3, the usage of the photo-electric sensor 100 is changed. Therefore, the sheet presence/absence flag stored in the RAM 123 is set to the "sheet presence", and when the sheet 3 is detected once, the sensor is set as the sheet rear end detection sensor until the rear edge of the sheet 3 is detected. Next, in Step S60, the sheet presence state is determined. Accordingly, the third state, that is, the state in which the sheet feeding cassette 9 is mounted in the cassette receiving portion 2A and the sheet 3 is transported is determined.

In Step S20, when the timer is not within the predetermined time (Step S20: No), the process proceeds to Step S70. In Step S70, it is determined whether or not the "sheet presence" is maintained. In a case where the sheet presence/absence flag stored in the RAM 123 is set to "sheet presence" and the sheet presence is maintained (Step S70: Yes), the process proceeds to the aforementioned Step S60, and the sheet presence is determined.

In addition, in Step S70, in a case where the sheet presence/absence flag stored in the RAM 123 is set to "sheet absence" and the sheet presence is not maintained (Step S70: No), the process proceeds to Step S80. In Step S80, it is determined that the sheet feeding cassette 9 is separated from the cassette receiving portion 2A. Accordingly, the first state, that is, the state in which the sheet feeding cassette 9 is separated can be determined. The state is displayed on, for example, the manipulation panel 133.

Subsequently, in Steps S60 and S80, the third and first states are determined, the process proceeds to Step S90. In Step S90, the timer value stored in the RAM 123 is counted down. In addition, with respect to the timer value stored in the RAM 123, when the feeding operation of the sheet feeding cassette 9 starts by the rotation of the feed roller 12 or the like, the timer value stored in the ROM 122 is read out by the CPU 121 and stored in a predetermined region of the RAM 123. More specifically, when the predetermined time interval from the time that the rotation of the feed rollers or the like is driven and the feeding operation of the sheet feeding cassette 9 starts is set to 2 sec, since the process shown in FIG. 14 is performed in the period of 5 msec, decimal number "400" may be stored as the timer value. After that, the entire process ends.

Now, operations and effects of the aspect will be described.

According to the aspect, the state (swing position) of the swing link 80 is changed according to the mounting and separating of the sheet feeding cassette 9 or the sheet transporting. More specifically, before the sheet 3 is transported, the swing link 80 is in the state that the swing link is supported by the receiving portion 79 of the sheet feeding cassette 9 at the lower surface thereof (second state). However, when the sheet 3 is transported, the supporting point is moved from the sheet feeding cassette 9 to the sheet 3. By the movement of the supporting point, the state of the swing link 80 is changed from the second state to the third state.

On the other hand, when the sheet feeding cassette 9 is separated, the supporting of the receiving portion 79 to the lower surface is released, and after, the swing link is in the non-supported state. By the change in the supporting, the state of the swing link 80 is changed from the second state to the first state. Accordingly, by detecting the change in state of the swing link 80, the both of the transporting of the sheet 3 and the mounting and separating of the sheet feeding cassette 9 can be detected.

In this manner, according to the aspect, within a predetermined time interval from the time that the sheet 3 is extracted from the sheet feeding cassette 9, when the photo-electric sensor 100 detects that the swing position of the swing link 80 is in a state other than the second state, it is determined that the state of the swing link is in the third state. Therefore, by using the photo-electric sensor 100 as a single detection unit, the transporting state of the sheet 3 and the presence and absence of the sheet feeding cassette 9 can be detected. As a result, the number of parts of the detecting unit can be reduced, the number of assembling processes can be reduced, and the assembly process can be simplified. Accordingly, it is possible to implement a small-sized device.

In the aspect, a case where a single sheet feeding cassette 9 is provided is exemplified, but the present invention may be applied to a case where a plurality of the sheet feeding cassettes 9 are provided. In a case where a plurality of the sheet feeding cassettes 9 are provided, a plurality of the counters for setting the timer values are individually provided to the sheet feeding cassettes 9.

Second Aspect

Now, operations of a control unit according to the present invention will be described with reference to FIGS. 15 to 18.

Figure 15:
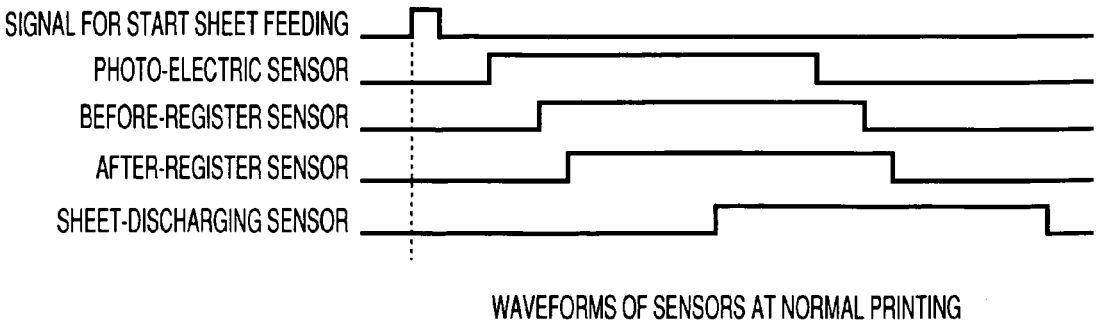
FIG. 15 is a timing chart showing waveforms of sensors during a normal printing period.
Figure 16:
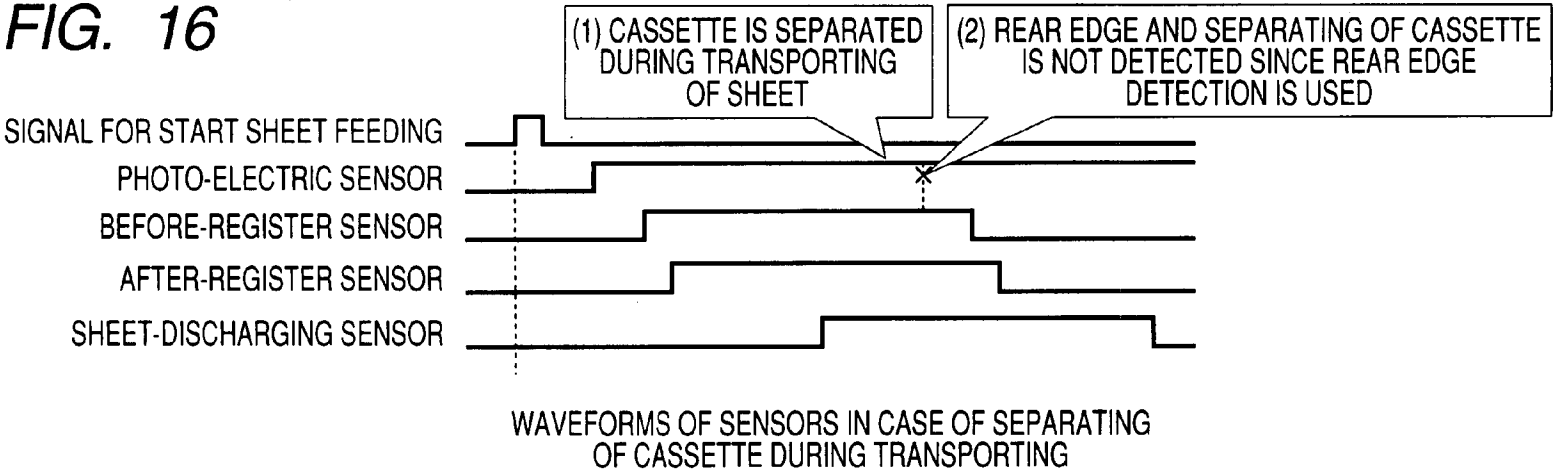
FIG. 16 is a timing chart showing waveforms of sensor when a sheet feeding cassette is separated during sheet transporting.
Figure 17:
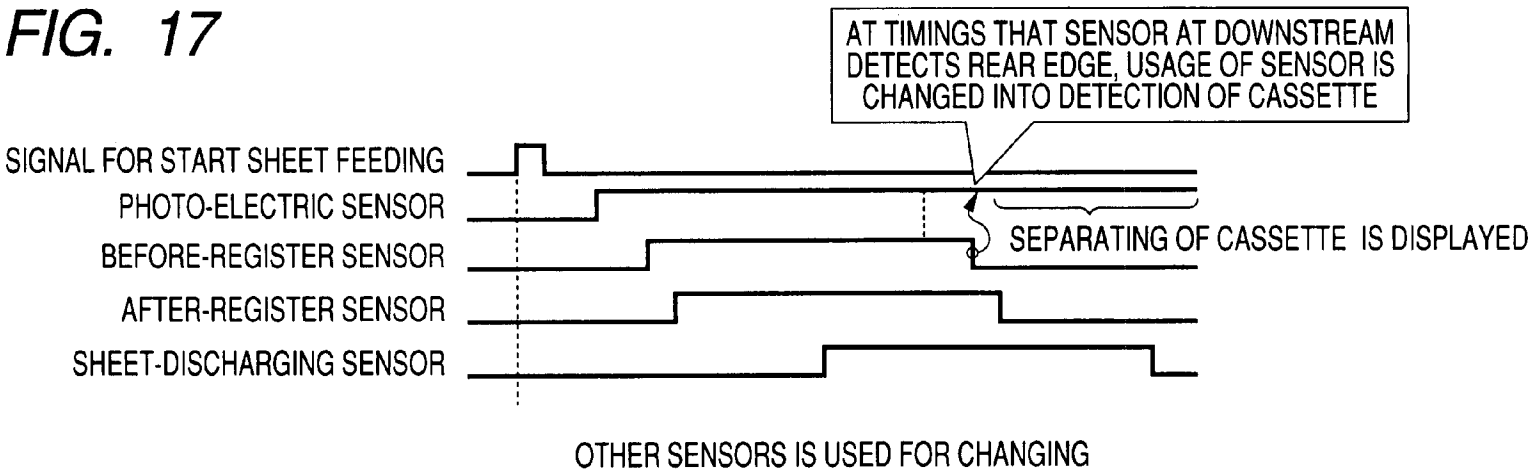
FIG. 17 is a timing chart showing waveforms of sensors according to another aspect of the invention.
Figure 18:
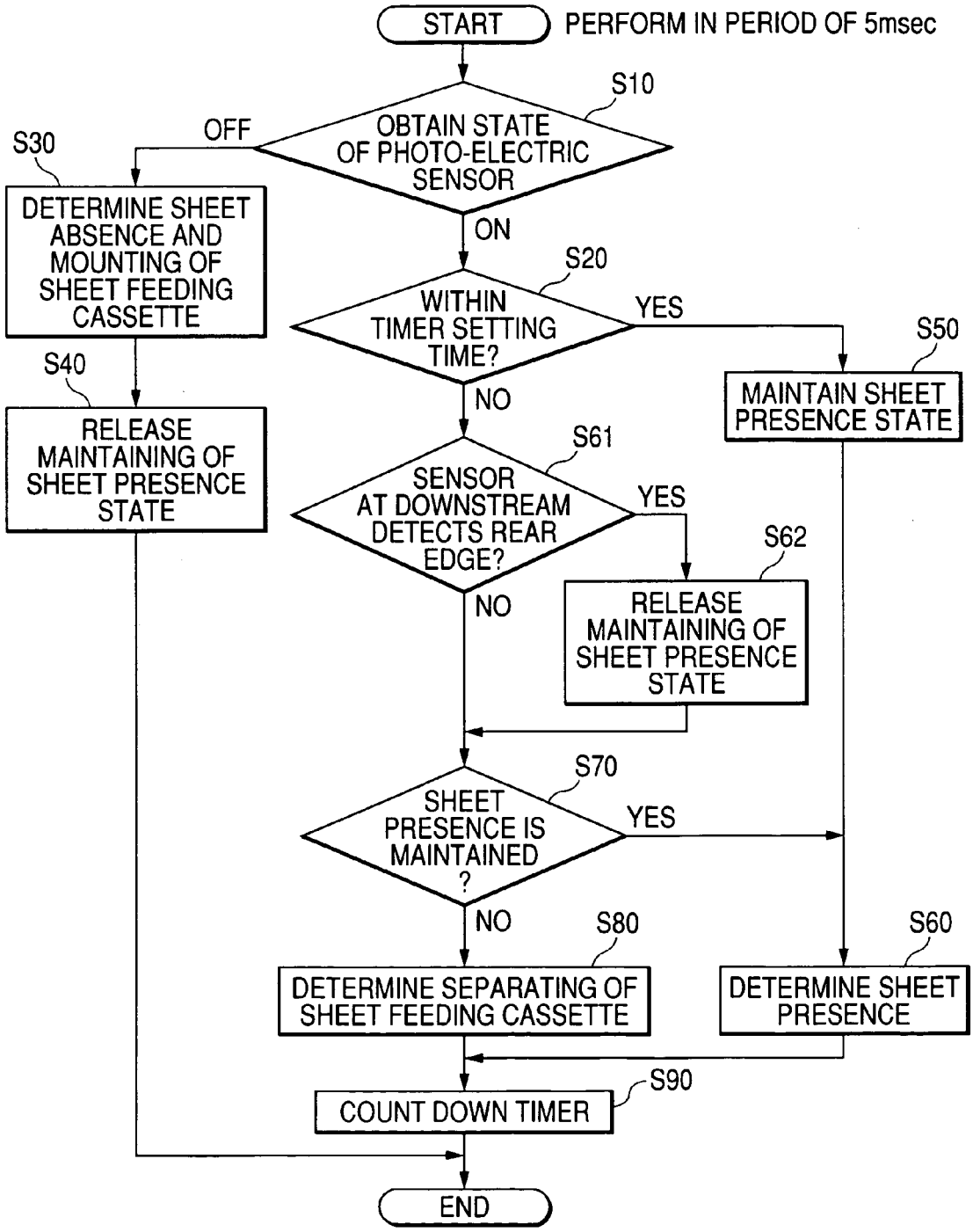
FIG. 18 is a flowchart showing operations of a control unit according to another aspect of the invention.

FIG. 15 is a timing chart showing waveforms of sensors during a normal printing period. FIG. 16 is a timing chart showing waveforms of sensor when a sheet feeding cassette is separated during sheet transporting. FIG. 17 is a timing chart showing waveforms of sensors according to a second aspect. FIG. 18 is a flowchart showing operations of a control unit according to the second aspect.

In this aspect, the whole construction thereof, the structure of detecting the mounting and separating of the sheet feeding cassette and the transporting of the sheet, and the constructions of the control unit are substantially the same as those of the first aspect, and thus, description thereof is omitted. Therefore, only construction and operations different from the first aspect will be described. In addition, in the description of the aspect, the same step numbers as those of FIG. 18 denote the same steps of the first aspect. In addition, in the aspect, the processes of the flowchart are performed in a period of 5 msec.

While the photo-electric sensor 100 operates as a detecting sensor for the sheet 3, when the sheet feeding cassette 9 is separated, as shown in FIGS. 15 and 16, the state in which the rear edge of the sheet 3 and the separating of the sheet feeding cassette 9 cannot be detected.

For the reason, in the aspect, in a case where the sheet feeding cassette 9 is separated during the transporting of the sheet 3, an after-register sensor 129 as the second detecting unit disposed at a downstream of the photo-electric sensor 100 in the sheet transporting path 56 shown in FIG. 1 is provided to detect the passing of the sheet 3 and the separating of the sheet feeding cassette 9 at the timing of detecting the rear edge of the sheet 3 as shown in FIG. 17.

As shown in the flowchart of FIG. 18, first, in Step S10, when the photo-electric sensor 100 is in the ON state (light receiving state) in Step S10, the process proceeds to Step S20. On the other hand, when the photo-electric sensor 100 is in the OFF state (light blocking), although the rotation of the feed roller 12 or the like is driven and the feeding operation of the sheet feeding cassette 9 starts, the photo-electric sensor 100 cannot detect the sheet 3. Therefore, the process proceeds to Step S30, and it is determined that the sheet 3 is absent and the sheet feeding cassette 9 is mounted. After that, the sheet presence/absence flag stored in the RAM 123 is set to "sheet absence" in Step S40, so that the maintaining of the sheet presence state is released, and the process ends. In the processes of Steps S30 and S40, the swing link 80 is in the second state.

In Step S10, in a case where the photo-electric sensor 100 is determined to be in the light receiving state, that is, in a case where the state of the swing link 89 is determined to be changed according to the transporting of the sheet 3, the process proceeds to Step S20. In Step S20, it is determined whether or not the timer is within a predetermined time as described above. When the timer is within the predetermined time (Step S20: Yes), the process proceeds to Step S50, and the sheet presence/absence flag stored in the RAM 123 is set to "sheet presence", so that the sheet presence state is maintained. Here, in a case where the sheet 3 is actually detected, when time-up occurs during the transporting of the sheet 3, the usage of the photo-electric sensor 100 is changed. Therefore, the sheet presence/absence flag stored in the RAM 123 is set, and when the sheet 3 is detected once, the sensor is set as the sheet rear end detection sensor until the rear edge of the sheet 3 is detected. Next, in Step S60, the sheet presence state is determined. Accordingly, the third state, that is, the state in which the sheet feeding cassette 9 is mounted in the cassette receiving portion 2A and the sheet 3 is transported is determined.

In Step S20, when the timer is not within the predetermined time (Step S20: No), the process proceeds to Step S61. In Step S61, the after-register sensor 129 disposed at the downstream of the photo-electric sensor 100 in the sheet transporting path 56 determines whether or not the rear edge of the sheet 3 is detected. When the rear edge of the sheet 3 is detected (Step S61: Yes), in Step S62, the sheet presence/absence flag stored in the RAM 123 is set to "sheet absence", and the maintaining of the sheet presence state is released. After that, the process proceeds to Step S70. When the rear edge of the sheet 3 is not detected (Step S61: No), the process directly proceeds to Step S70.

Subsequently, in Step S70, it is determined whether or not the "sheet presence" is maintained. In a case where the sheet presence is maintained (Step S70: Yes), the process proceeds to the aforementioned Step S60, and the sheet presence is determined.

In addition, in Step S70, in a case where the sheet presence is not maintained (Step S70: No), the process proceeds to Step S80. In Step S80, it is determined that the sheet feeding cassette 9 is separated from the cassette receiving portion 2A. Accordingly, the first state, that is, the state in which the sheet feeding cassette 9 is separated can be determined. The state is display on, for example, the manipulation panel 133.

Subsequently, in Steps S60 and S80, the third and first states are determined, the process proceeds to Step S90. In Step S90, the timer value stored in the RAM 123 is counted down. After that, the entire process ends.

In this manner, according to the aspect, after a predetermined time interval from the time that the sheet 3 is extracted from the sheet feeding cassette 9, when the after-register sensor 129 does not detect the sheet 3, and when the photo-electric sensor 100 detects that the swing position of the swing link 80 is in a state other than the second state, it is determined that the sheet feeding cassette 9 is in the separated state. Therefore, the transporting state of the sheet 3 and the separating of the sheet feeding cassette 9 can be accurately detected. In addition, with respect to the timer value stored in the RAM 123, when the feeding operation of the sheet feeding cassette 9 starts by the rotation of the feed roller 12 or the like, the timer value stored in the ROM 122 is read out by the CPU 121 and stored in a predetermined region of the RAM 123.

In addition, in the aspect, the after-register sensor 129 is used as the second detecting unit disposed at the downstream of the photo-electric sensor 100 in the sheet transporting path 56, but not limited thereto. The before-register sensor 128, the sheet-discharging sensor 130, or any other sensors disposed at the downstream of the photo-electric sensor 100 may be used.

Third Aspect

Now, operation of a control unit according to a third aspect of the present invention will be described with reference to FIGS. 19 and 20.

Figure 19:
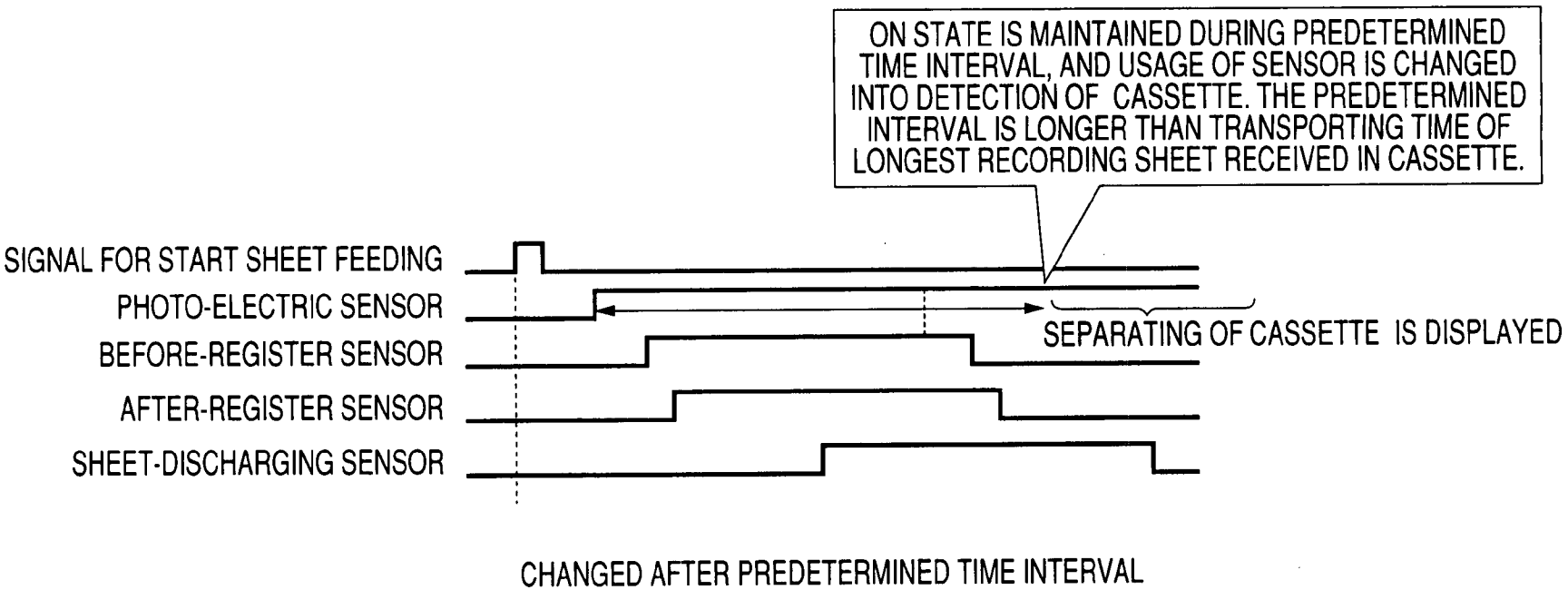
FIG. 19 is a timing chart showing waveforms of sensors according to another aspect of the invention.

FIG. 19 is a timing chart showing waveforms of sensors according to the third aspect. FIG. 20 is a flowchart showing operations of the control unit according to the third aspect.

In the aspect, in a case where the photo-electric sensor 100 is used as a sensor for detecting the rear edge of the sheet 3, the construction in which the time of the sheet presence state is shorter that the transporting time for the longest recoding sheet is used. In a case where the sheet presence state is maintained in a predetermined time or more, the usage of the photo-electric sensor 100 is changed into the detection of the mounting and separating of the sheet feeding cassette 9.

In this aspect, the whole construction thereof, the structure of detecting the mounting and separating of the sheet feeding cassette and the transporting of the sheet, and the constructions of the control unit are substantially the same as those of the first aspect, and thus, description thereof is omitted. Therefore, only the different construction and operations from the first embedment will be described. In addition, in the description of the aspect, the same step numbers as those of FIG. 18 denote the same steps of the first aspect. In addition, in the aspect, the processes of the flowchart are performed in a period of 5 msec.

Figure 20:
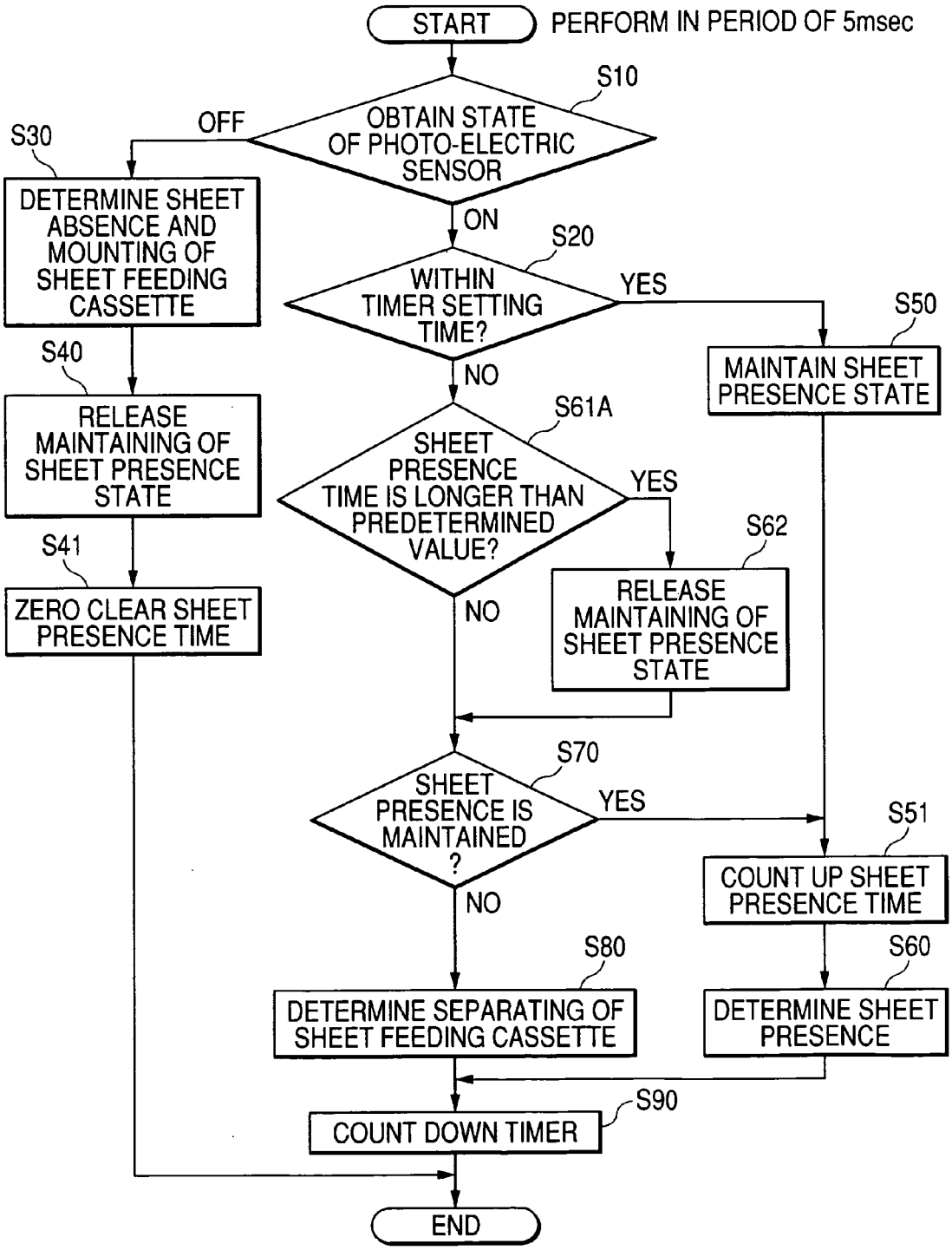
FIG. 20 is a flowchart showing operations of the control unit according to the aspect of the invention.

As shown in the flowchart of FIG. 20, first, when the photo-electric sensor 100 is in the ON state (light receiving state) in Step S20, the process proceeds to Step S20. On the other hand, when the photo-electric sensor 100 is in the OFF state (light blocking), the process proceeds to Step S30, and it is determined that the sheet 3 is absent and the sheet feeding cassette 9 is mounted. After that, the sheet presence/absence flag stored in the RAM 123 is set to "sheet absence" in Step S40, so that the maintaining of the sheet presence state is released, and the sheet presence time stored in a predetermined region of the RAM 123 is cleared to be zero (Step S41), so the process ends. In the processes of Steps S30 and S40, the swing link 80 is in the second state.

In Step S10, in a case where the photo-electric sensor 100 is determined to be in the light receiving state, that is, in a case where the state of the swing link 89 is determined to be changed, the process proceeds to Step S20. In Step S20, it is determined whether or not the timer is within a predetermined time as described above. When the timer is within the predetermined time (Step S20: Yes), the process proceeds to Step S50, and the sheet presence state is maintained. Next, in Step S51, the sheet presence time is counted up, and after that, in Step S60, the sheet presence is determined. Accordingly, the third state, that is, the state in which the sheet feeding cassette 9 is mounted in the cassette receiving portion 2A and the sheet 3 is transported is determined.

In Step S20, when the timer is not within the predetermined time (Step S20: No), the process proceeds to Step S61A. In Step S61A, in a case where the sheet presence time stored in a predetermined regions of the RAM 123 is equal to or larger than a predetermined value, in a case where the sheet presence time is longer than the transporting time for the longest recording sheet (Step S61A: Yes), the sheet presence/absence flag stored in the RAM 123 is set to the "sheet absence" in Step S62, so that the maintaining of the sheet presence state is released. After that, the process proceeds to Step S70. On the other hand, in a case where the sheet presence time stored in the predetermined regions of the RAM 123 is less than the predetermined value, that is, in a case where the sheet presence time is shorter than the transporting time for the longest recording sheet (Step S61A: No), the process directly proceeds to Step S70.

Subsequently, in Step S70, it is determined whether or not the "sheet presence" is maintained. In a case where the sheet presence is maintained (Step S70: Yes), the process proceeds to the aforementioned Step S51, and the sheet presence time is counted up. After that, in Step S60, the sheet presence is determined.

In addition, in Step S70, in a case where the sheet presence is not maintained (Step S70: No), the process proceeds to Step S80. Here, in a case where the sheet presence time stored in a predetermined regions of the RAM 123 is equal to or larger than a predetermined value, in a case where the sheet presence time is longer than the transporting time for the longest recording sheet (Step S61A: Yes), the sheet presence/absence flag stored in the RAM 123 is set to the "sheet absence", so that the maintaining of the sheet presence state is released. Therefore, the process proceeds to Step S80. In Step S80, it is determined that the sheet feeding cassette 9 is separated from the cassette receiving portion 2A. Accordingly, the first state, that is, the state in which the sheet feeding cassette 9 is separated can be determined. The state is display on, for example, the manipulation panel 133.

Subsequently, in Steps S60 and S80, the third and first states are determined, the process proceeds to Step S90. In Step S90, the timer value stored in the RAM 123 is counted down. After that, the entire process ends.

In this manner, according to the present invention, when the photo-electric sensor 100 detects that the swing position of the swing link 80 is in the second state, that is, in the state in which the sheet feeding cassette 9 is mounted and the sheet 3 is not transported for a predetermined time or more, it is determined that the sheet feeding cassette 9 is determined to be in the separated state, so that the separating of the sheet feeding cassette 9 can be accurately detected.

Fourth Aspect

Now, operations of a control unit according to a fourth aspect will be described with reference to FIGS. 21 to 23.

Figure 21:
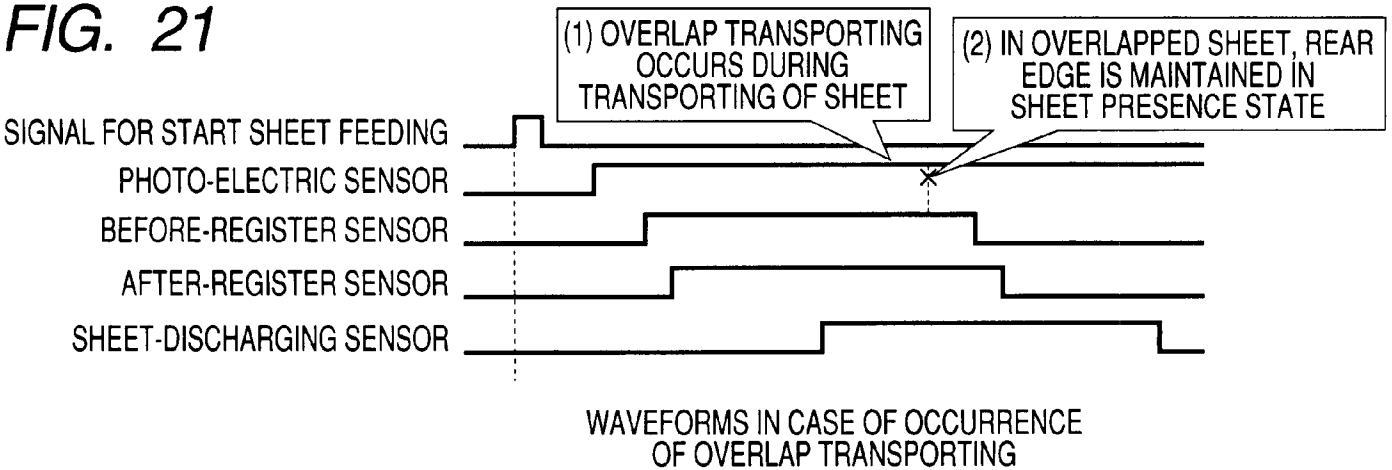
FIG. 21 is a timing chart showing waveforms of sensors in a case where overlap transporting occurs.
Figure 22:
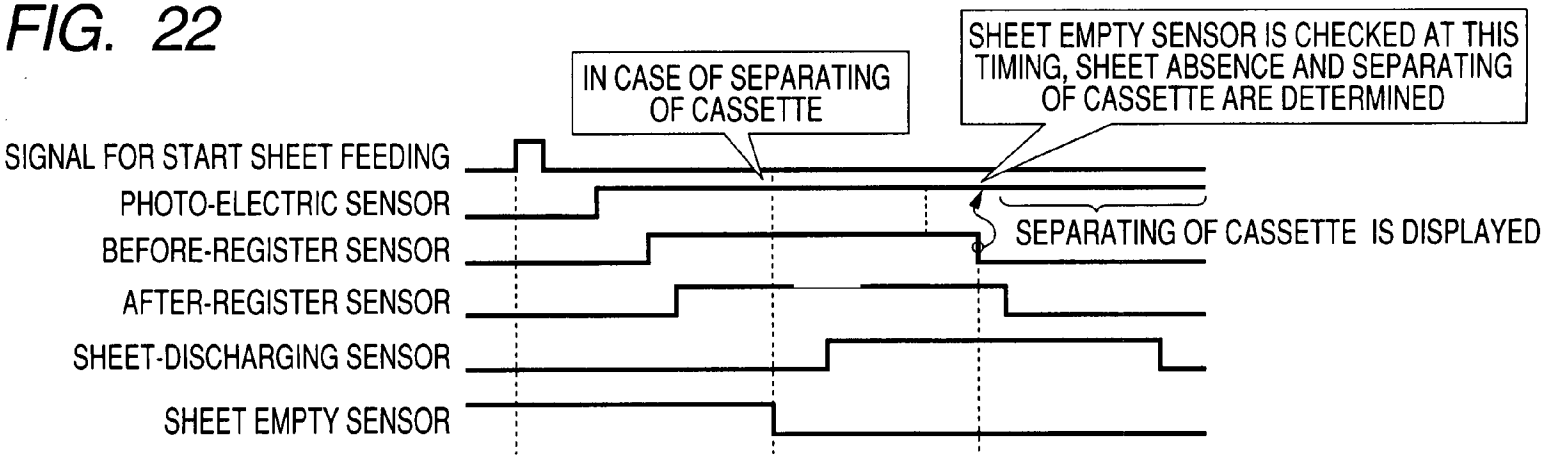
FIG. 22 is a timing chart showing waveforms of sensors for determining overlap transporting by using a sheet empty sensor in a case where the overlap transporting occurs.

FIG. 21 is a timing chart showing waveforms of sensors in a case where overlap transporting occurs. FIG. 22 is a timing chart showing waveforms of sensors for determining overlap transporting by using a sheet empty sensor in a case where the overlap transporting occurs. FIG. 23 is a flowchart showing operations of a control unit according to a fourth aspect.

In the aspect, the whole construction of the thereof, the structure of detecting the mounting and separating of the sheet feeding cassette and the transporting of the sheet, and the constructions of the control unit are substantially the same as those of the first aspect, and thus, description thereof is omitted. Therefore, only the different construction and operations from the first embedment will be described. In addition, in the description of the aspect, the same step numbers as those of FIG. 18 denote the same steps of the first aspect. In addition, in the aspect, the processes of the flowchart are performed in a period of 5 msec.

When one sheet of the sheets 3 is extracted from the sheet feeding cassette 9, an overlap transporting phenomenon that the next sheet slightly overlaps the sheet of the sheet due to friction therebetween may occurs. In a case where the phenomenon occurs, the rear edge of the sheet 3 cannot be detected by using sensor waveforms same as those of the aforementioned case where the sheet feeding cassette 9 is separated during the transporting of the sheet 3. In addition, when the process for the case where the sheet feeding cassettes 9 is separated during the transporting of the sheet is performed, although the sheet feeding cassette 9 is not separated, there is a problem in that the separating of the sheet feeding cassette 9 may be displayed.

Therefore, in the aspect, by using a construction that, when the sheet feeding cassette 9 is separated, the sheet empty sensor 131 is in the sheet absence state, the overlap transporting and the separating of the sheet feeding cassette 9 are detected. More specifically, when the presence and absence of the sheet 3 is detected by the sheet empty sensor 131 at any timings descried in FIGS. 16 and 17, when the sheet 3 is present, the overlap transporting is determined. When the sheet 3 is absent, the separated state of the sheet feeding cassette 9 is determined.

Figure 23:
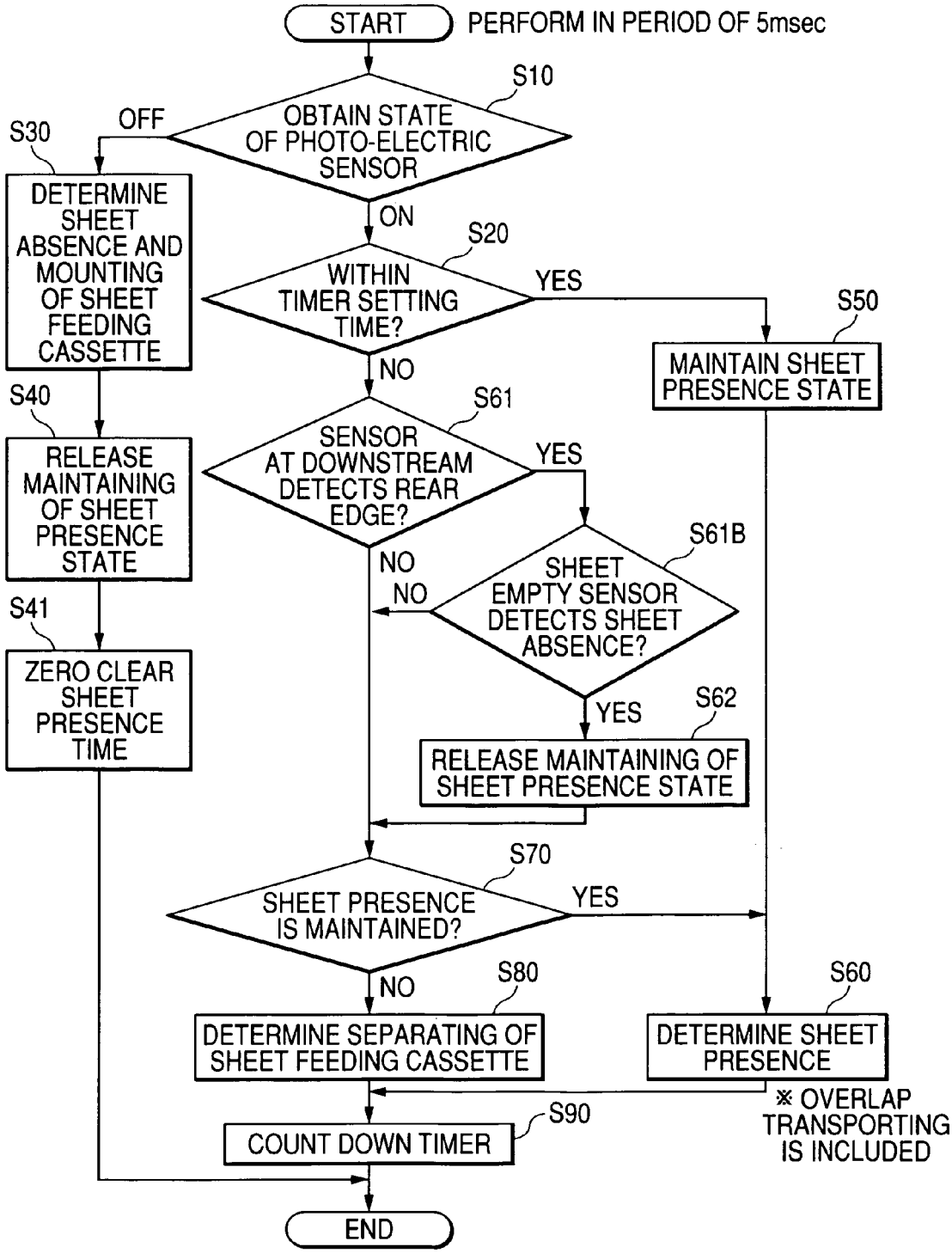
FIG. 23 is a flowchart showing operations of a control unit according to another aspect of the invention.

As shown in the flowchart of FIG. 23, firstly, when the photo-electric sensor 100 is in the ON state (light receiving state) in Step S20, the process proceeds to Step S20. On the other hand, when the photo-electric sensor 100 is in the OFF state (light blocking), the process proceeds to Step S30, and it is determined that the sheet 3 is absent and the sheet feeding cassette 9 is mounted. After that, in Step S40, the maintaining of the sheet presence state is released, and the sheet presence time is cleared to be zero (Step S41), so that the process ends. In the processes of Steps S30 and S40, the swing link 80 is in the second state.

In Step S10, in a case where the photo-electric sensor 100 is determined to be in the light receiving state, that is, in a case where the state of the swing link 89 is determined to be changed, the process proceeds to Step S20. In Step S20, it is determined whether or not the timer is within a predetermined time as described above. When the timer is within the predetermined time (Step S20: Yes), the process proceeds to Step S50, and the sheet presence state is maintained. Next, in Step S60, the sheet presence is determined. Accordingly, the third state, that is, the state that the sheet feeding cassette 9 is mounted in the cassette receiving portion 2A and the sheet 3 is transported is determined.

In Step S20, when the timer is not within the predetermined time (Step S20: No), the process proceeds to Step S61. In Step S61, the after-register sensor 129 disposed at the downstream of the photo-electric sensor 100 in the sheet transporting path 56 determines whether or not the rear edge of the sheet 3 is detected. In a case where the rear edge of the sheet 3 is detected (Step S61: Yes), when the sheet empty sensor 131 detects the sheet absence in Step S61B (Step S61B: Yes), the maintaining of the sheet presence state is released in Step S62, and the process proceeds to Step S70.

On the other hand, in a case where the rear edge of the sheet 3 is detected in Step S61 (Step S61: No), when the sheet empty sensor does not detect the sheet absence in Step S61B (Step S61B: No), the process directly proceeds to Step S70.

Subsequently, in Step S70, it is determined whether or not the "sheet presence" is maintained. In a case where the sheet presence is maintained (Step S70: Yes), the process proceeds to the aforementioned Step S51, and the sheet presence time is counted up. After that, in Step S60, the sheet presence is determined.

In addition, in Step S70, in a case where the sheet presence is not maintained (Step S70: No), the process proceeds to Step S80. Here, in a case where the sheet empty sensor 131 detects the sheet absence (Step S61B: Yes), the sheet presence/absence flag stored in the RAM 123 is set to the "sheet absence" in Step S62, so that the sheet presence remaining state is released. Accordingly, the process proceeds to Step S80. In Step S80, it is determined that the sheet feeding cassette 9 is separated from the cassette receiving portion 2A. Accordingly, the first state, that is, the state in which the sheet feeding cassette 9 is separated can be determined. The state is display on, for example, the manipulation panel 133.

Subsequently, in Steps S60 and S80, the third and first states are determined, the process proceeds to Step S90. In Step S90, the timer set as described above is counted down. After that, the entire process ends.

In this manner, according to the aspect, when the after-register sensor 129 detects the rear edge of the sheet 3, when the photo-electric sensor 100 detects that the swing position of the swing link 80 is in a state other than the second state, and when the sheet empty sensor 131 detects the sheet presence, the overlap transporting of the sheet is determined. Accordingly, the overlap transporting can be accurately detected. According to the aspects, the second detecting unit may be any one of a before-register sensor, an after-register sensor, and a sheet-discharging sensor. Therefore, there is no need for providing other detecting units for detecting a transporting state of a new sheet. As a result, an increase in number of parts and assembling processes can be prevented.

[FIG. 12]

PC: DATA TRANSMITTER

133: MANIPULATION PANEL

DC: CONTROL CIRCUIT

140: DRIVING CIRCUIT

127: TONER SENSOR

100: PHOTO-ELECTRIC SENSOR

128: BEFORE-REGISTER SENSOR

129: AFTER-REGISTER SENSOR

130: SHEET-DISCHARGING SENSOR

131: SHEET EMPTY SENSOR

[FIG. 14]

S10: OBTAIN STATE OF PHOTO-ELECTRIC SENSOR

S20: WITHIN TIMER SETTING TIME?

S30: DETERMINE SHEET ABSENCE AND MOUNTING OF SHEET FEETING CASSETTE
S40: RELEASE MAINTAINING OF SHEET PRESENCE STATE
S50: MAINTAIN SHEET PRESENCE STATE
S60: DETERMINE SHEET PRESENCE
S70: SHEET PRESENCE IS MAINTAINED?
S80: DETERMINE SEPARATING OF SHEET FEEDING CASSETTE
S90: COUNT DOWN TIMER
[FIG. 16]
(1) CASSETTE IS SEPARATED DURING TRANSPORTING OF SHEET
(2) REAR EDGE AND SEPARATING OF CASSETTE IS NOT DETECTED SINCE REAR EDGE DETECTION IS USED
[FIG. 18]
S10: OBTAIN STATE OF PHOTO-ELECTRIC SENSOR
S20: WITHIN TIMER SETTING TIME?
S30: DETERMINE SHEET ABSENCE AND MOUNTING OF SHEET FEETING CASSETTE
S40: RELEASE MAINTAINING OF SHEET PRESENCE STATE
S50: MAINTAIN SHEET PRESENCE STATE
S61 SENSOR AT DOWNSTREAM DETECTS REAR EDGE?
S62 RELEASE MAINTAINING OF SHEET PRESENCE STATE
S60: DETERMINE SHEET PRESENCE
S70: SHEET PRESENCE IS MAINTAINED?
S80: DETERMINE SEPARATING OF SHEET FEEDING CASSETTE
S90: COUNT DOWN TIMER
[FIG. 20]
S10: OBTAIN STATE OF PHOTO-ELECTRIC SENSOR
S20: WITHIN TIMER SETTING TIME?
S30: DETERMINE SHEET ABSENCE AND MOUNTING OF SHEET FEEDING CASSETTE
S40: RELEASE MAINTAINING OF SHEET PRESENCE STATE
S41: ZERO CLEAR SHEET PRESENCE TIME
S50: MAINTAIN SHEET PRESENCE STATE
S61A SHEET PRESENCE TIME IS LONGER THAN PREDETERMINED VALUE?
S62 RELEASE MAINTAINING OF SHEET PRESENCE STATE
S60: DETERMINE SHEET PRESENCE
S70: SHEET PRESENCE IS MAINTAINED?
S51: COUNT UP SHEET PRESENCE TIME
S80: DETERMINE SEPARATING OF SHEET FEEDING CASSETTE
S90: COUNT DOWN TIMER
[FIG. 21]
(1) OVERLAP TRANSPORTING OCCURS DURING TRANSPORTING OF SHEET
(2) IN OVERLAPPED SHEET, REAR EDGE IS MAINTAINED IN SHEET PRESENCE STATE
[FIG. 23]
S10: OBTAIN STATE OF PHOTO-ELECTRIC SENSOR
S20: WITHIN TIMER SETTING TIME?
S30: DETERMINE SHEET ABSENCE AND MOUNTING OF SHEET FEEDING CASSETTE
S40: RELEASE MAINTAINING OF SHEET PRESENCE STATE
S41: ZERO CLEAR SHEET PRESENCE TIME
S50: MAINTAIN SHEET PRESENCE STATE
S61 SENSOR AT DOWNSTREAM DETECTS REAR EDGE?
S61B SHEET EMPTY SENSOR DETECTS SHEET ABSENCE?
S62 RELEASE MAINTAINING OF SHEET PRESENCE STATE
S60: DETERMINE SHEET PRESENCE
S70: SHEET PRESENCE IS MAINTAINED?
S80: DETERMINE SEPARATING OF SHEET FEEDING CASSETTE
S90: COUNT DOWN TIMER

What is claimed is:

1. A sheet transporting device comprising:
a main body;
a sheet feeding cassette detachable from the main body;
a transporting unit that extracts sheets sheet-by-sheet and transports the sheet from the sheet feeding cassette;
a swing member swingably supported by a shaft to the main body, and the swing member including a swing position, which changes among a first state in which the sheet feeding cassette is separated, a second state in which the sheet feeding cassette is mounted and the sheet is not transported, and a third state in which the sheet feeding cassette is mounted and the sheet is being transported;
a detecting unit configured to detect the state of the swing member and configured to send a signal indicating whether the swing position of the swing member is in the second state or other states; and
a control unit configured to receive the signal from the detecting unit and configured to determine whether the swing position is in the first state or the third state based on the signal from the detection unit, wherein
the control unit determines that the swing position is in the third state when the control unit receives the signal from the detecting unit indicating the swing position of the swing member is in a state other than the second state within a predetermined time interval from the time that the transporting unit extracts the sheet from the sheet feeding cassette.

2. A sheet transporting device comprising:
a main body;
a sheet feeding cassette detachable from the main body;
a transporting unit that extracts sheets sheet-by-sheet and transports the sheet from the sheet feeding cassette;
a swing member swingably supported by a shaft to the main body, and the swing member including a swing position, which changes among a first state in which the sheet feeding cassette is separated, a second state in which the sheet feeding cassette is mounted and the sheet is not transported, and a third state in which the sheet feeding cassette is mounted and the sheet is being transported;
a first detecting unit for detecting whether the swing position of the swing member is in the second state or other states and configured to send a first signal indicating the detection result;
a second detecting unit disposed at a downstream of the first detecting unit in a sheet transporting path to detect a sheet transporting state and configured to send a second signal indicating the detection result;
a control unit configured to receive the signals from the first and second detecting units and configured to determine whether the sheet feeding cassette is mounted or separated based on the first and second signals, wherein
the control unit determines that the sheet feeding cassette is separated when the control unit receives the second signal from the second detecting unit indicating the second detection unit does not detect the sheet and the first signal from the first detecting unit indicating the first detecting unit detects that the swing position of the swing member is in a state other than the second state after a predetermined time interval from the time that the transporting unit extracts the sheet from the sheet feeding cassette.

3. A sheet transporting device comprising:

a main body;

a sheet feeding cassette detachable from the main body;

a transporting unit that extracts sheets sheet-by-sheet and transports the sheet from the sheet feeding cassette;

a swing member swingably supported by a shaft to the main body, and the swing member including a swing position, which changes among a first state in which the sheet feeding cassette is separated, a second state in which the sheet feeding cassette is mounted and the sheet is not transported, and a third state in which the sheet feeding cassette is mounted and the sheet is being transported;

a first detecting unit for detecting whether the swing position of the swing member is in the second state or other states and sending a first signal indicating the detection result;

a second detecting unit disposed at a downstream of the first detecting unit in a sheet transporting path and sending a second signal indicating the detection result;

a third detecting unit for detecting a presence or absence of the sheet in the sheet feeding cassette and sending a third signal indicating the detection result; and a control unit configured to receive the first, second and third signals from the first, second and third detecting units and configured to determine whether the sheet is in an overlap transporting state or not based on the first, second and third signals, wherein the control unit determines that the sheet is in the overlap transporting state when the control unit receives the second signal from the second detecting unit indicating detection of a rear portion of the sheet, the first signal from the first detecting unit indicating the swing position of the swing member is in a state other than the second state, and the third signal from the third detecting unit indicating detection of the presence of the sheet.

4. The sheet transporting device according to claim 2, wherein the second detecting unit is a before-register sensor.

5. The sheet transporting device according to claim 2, wherein the second detecting unit is an after-register sensor.

6. The sheet transporting device according to claim 2, wherein the second detecting unit is a sheet-discharging sensor.

7. The sheet transporting device according to claim 3, wherein the second detecting unit is a before-register sensor.

8. The sheet transporting device according to claim 3, wherein the second detecting unit is an after-register sensor.

9. The sheet transporting device according to claim 3, wherein the second detecting unit is a sheet-discharging sensor.

10. A sheet transporting device comprising:

a main body;

a sheet feeding cassette detachable from the main body;

a transporting unit that extracts sheets sheet-by-sheet and transports the sheet from the sheet feeding cassette;

a swing member swingably supported by a shaft to the main body, and the swing member including a swing position, which changes among a first state in which the sheet feeding cassette is separated, a second state in which the sheet feeding cassette is mounted and the sheet is not transported, and a third state in which the sheet feeding cassette is mounted and the sheet is being transported;

a detecting unit configured to detect the state of the swing member and configured to send a signal indicating whether the swing position of the swing member is in the second state or other states; and a control unit configured to receive the signal from the detecting unit and configured to determine whether the sheet feeding cassette is mounted or separated based on the signal, wherein the control unit determines that the sheet feeding cassette is separated when the control unit receives the signal from the detecting unit indicating the swing position of the swing member is in a state other than the second state for a predetermined time or more.

11. An image forming apparatus comprising;

an image forming unit that transferees a developer image; and a sheet transporting device including:

a main body;

a sheet feeding cassette detachable from the main body;

a transporting unit that extracts sheets sheet-by-sheet and transports the sheet from the sheet feeding cassette;

a swing member swingably supported by a shaft to the main body, and the swing member including a swing position, which changes among a first state in which the sheet feeding cassette is separated, a second state in which the sheet feeding cassette is mounted and the sheet is not transported, and a third state in which the sheet feeding cassette is mounted and the sheet is transported;

a detecting unit configured to detect the state of the swing member and configured to send a signal indicating whether the swing position of the swing member is in the second state or other states; and a control unit configured to receive the signal from the detecting unit and configured to determine whether the swing position is in the first state or the third state based on the signal, wherein the control unit determines that the swing position is in the third state when the control unit receives the signal from the detecting unit indicating the swing position of the swing member is in a state other than the second state within a predetermined time interval from the time that the transporting unit extracts the sheet from the sheet feeding cassette.

12. The sheet transporting device according to claim 1, further comprising a timer which measures the predetermined time interval from the time that the transporting unit extracts the sheet from the sheet feeding cassette.

13. The sheet transporting device according to claim 2, further comprising a timer which measures the predetermined time interval from the time that the transporting unit extracts the sheet from the sheet feeding cassette.

14. The sheet transporting device according to claim 10, further comprising a timer which measures the predetermined time.

15. The image forming apparatus according to claim 11, wherein the sheet transporting device further includes a timer which measures the predetermined time interval from the time that the transporting unit extracts the sheet from the sheet feeding cassette.

16. The sheet transporting device according to claim 1, wherein the control unit determines that the swing position is in the third state when the control unit receives the signal from the detecting unit indicating that the swing position of the swing member is in a state other than the second state, after the predetermined time interval from the time that the transporting unit extracts the sheet from the sheet feeding cassette.

17. The image forming apparatus according to claim 11, wherein the control unit determines that the swing position is in the third state when the control unit receives the signal from the detecting unit indicating that the swing position of the swing member is in a state other than the second state, after the predetermined time interval from the time that the transporting unit extracts the sheet from the sheet feeding cassette.

* * * * *